US012209467B2

(12) United States Patent
Gupta et al.

(10) Patent No.: US 12,209,467 B2
(45) Date of Patent: Jan. 28, 2025

(54) PIVOT JOINT WITH A ROTATABLE LOWER PORTION

(71) Applicant: Nabors Drilling Technologies USA, Inc., Houston, TX (US)

(72) Inventors: Ashish Gupta, Houston, TX (US); Marinel Mihai, Calgary (CA); Hendrik Schalk Le Roux, Calgary (CA); Geoffrey Marjoram, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/397,523

(22) Filed: Dec. 27, 2023

(65) Prior Publication Data

US 2024/0218751 A1 Jul. 4, 2024

Related U.S. Application Data

(60) Provisional application No. 63/477,521, filed on Dec. 28, 2022.

(51) Int. Cl.

| | |
|---|---|
| ***E21B 19/06*** | (2006.01) |
| ***E21B 19/087*** | (2006.01) |
| ***E21B 19/20*** | (2006.01) |
| *E21B 3/02* | (2006.01) |

(52) U.S. Cl.

CPC ..... *E21B 19/20* (2013.01); *E21B 19/06* (2013.01); *E21B 19/087* (2013.01); *E21B 3/022* (2020.05)

(58) Field of Classification Search

CPC ..... E21B 19/06; E21B 19/087; E21B 19/20

See application file for complete search history.

(56) References Cited

U.S. PATENT DOCUMENTS

| | | | | |
|---|---|---|---|---|
| 4,890,681 | A * | 1/1990 | Skelly | E21B 3/02 414/22.52 |
| 6,938,697 | B2 * | 9/2005 | Haugen | E21B 41/0021 166/85.1 |
| 2004/0251050 | A1 * | 12/2004 | Shahin | E21B 19/161 166/380 |
| 2005/0173154 | A1 * | 8/2005 | Lesko | E21B 19/20 175/57 |
| 2007/0000668 | A1 * | 1/2007 | Christensen | E21B 19/06 166/380 |
| 2007/0095524 | A1 * | 5/2007 | Lesko | E21B 19/087 166/77.51 |
| 2014/0262336 | A1 * | 9/2014 | Nikiforuk | E21B 19/14 166/380 |
| 2017/0314330 | A1 * | 11/2017 | Jantzen | E21B 3/022 |

* cited by examiner

*Primary Examiner* — Matthew R Buck

(74) *Attorney, Agent, or Firm* — Abel Schillinger, LLP

(57) ABSTRACT

A system can include a top drive with a quill with a pivot joint, with an upper portion pivotably coupled to a lower portion via a pivot, coupled between the quill and a running tool, wherein rotation of the lower portion relative to the upper portion pivots the running tool about the pivot. A method for running a tubular string by moving a tubular along a catwalk, coupling a pivot joint between a running tool and a quill, and pivoting the running tool about the pivot by pivoting the lower portion relative to the upper portion.

20 Claims, 17 Drawing Sheets

PIVOT JOINT WITH A ROTATABLE LOWER PORTION

CROSS-REFERENCE TO RELATED APPLICATION(S)

This application claims priority under 35 U.S.C. § 119(c) to U.S. Provisional Application No. 63/477,521, entitled "A PIVOT JOINT WITH A ROTATABLE LOWER PORTION," by Ashish GUPTA et al., filed Dec. 28, 2022, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for manipulating a running tool during subterranean operations using a pivot joint.

BACKGROUND

During drilling a section of a wellbore in a subterranean formation, the rig can be utilized to run a tubular string (e.g., a casing string) into or out of the wellbore to perform further subterranean operations (e.g., installing a casing string in a new section of the wellbore; retrieving at least a portion of the casing string from the wellbore, running a drill string into or out of the wellbore, etc.). Tripping a tubular string into the wellbore generally includes lifting tubulars from a catwalk via an elevator or receiving them from a vertical storage area via an elevator. A top drive can hoist a tubular to a vertical position above the well center by hoisting the elevator that is engaging the tubular. With the tubular in a vertical orientation, the top drive can then engage the top end of the tubular with a running tool. The elevator can then be released. However, due to continuously improving well bore construction methods, improvements in running tubular strings into or out of a wellbore are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a system for running a tubular string into or out of a wellbore. The system can include a top drive with a quill; and a pivot joint coupled between the quill and a running tool, the pivot joint may include an upper portion that is pivotably coupled to a lower portion via a pivot, where rotation of the lower portion relative to the upper portion pivots the running tool about the pivot.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method for running a tubular string in a subterranean operation. The method also includes moving a tubular along a catwalk toward a well center, where the tubular is disposed at an angle, relative to a rig floor; coupling a pivot joint between a running tool and a quill of a top drive, where the pivot joint may include an upper portion that is pivotably coupled to a lower portion via a pivot; lowering the top drive to a desired location to receive the tubular via the running tool; and pivoting the running tool about the pivot by pivoting the lower portion relative to the upper portion. Other embodiments of this aspect include corresponding computer systems, apparatus, and computer programs recorded on one or more computer storage devices, each configured to perform the actions of the methods.

One general aspect includes a method for running a tubular string in a subterranean operation. The method also includes coupling a pivot joint between a running tool and a quill of a top drive, where the pivot joint may include an upper portion that is pivotably coupled to a lower portion via a pivot; engaging, via the running tool, a tubular string at a well center; raising the tubular string from a wellbore by raising the top drive to a desired vertical height; breaking up a connection between a tubular at a top of the tubular string and the tubular string; and pivoting the running tool about the pivot by pivoting the lower portion relative to the upper portion, thereby pivoting the tubular about the pivot. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

Figure 1:
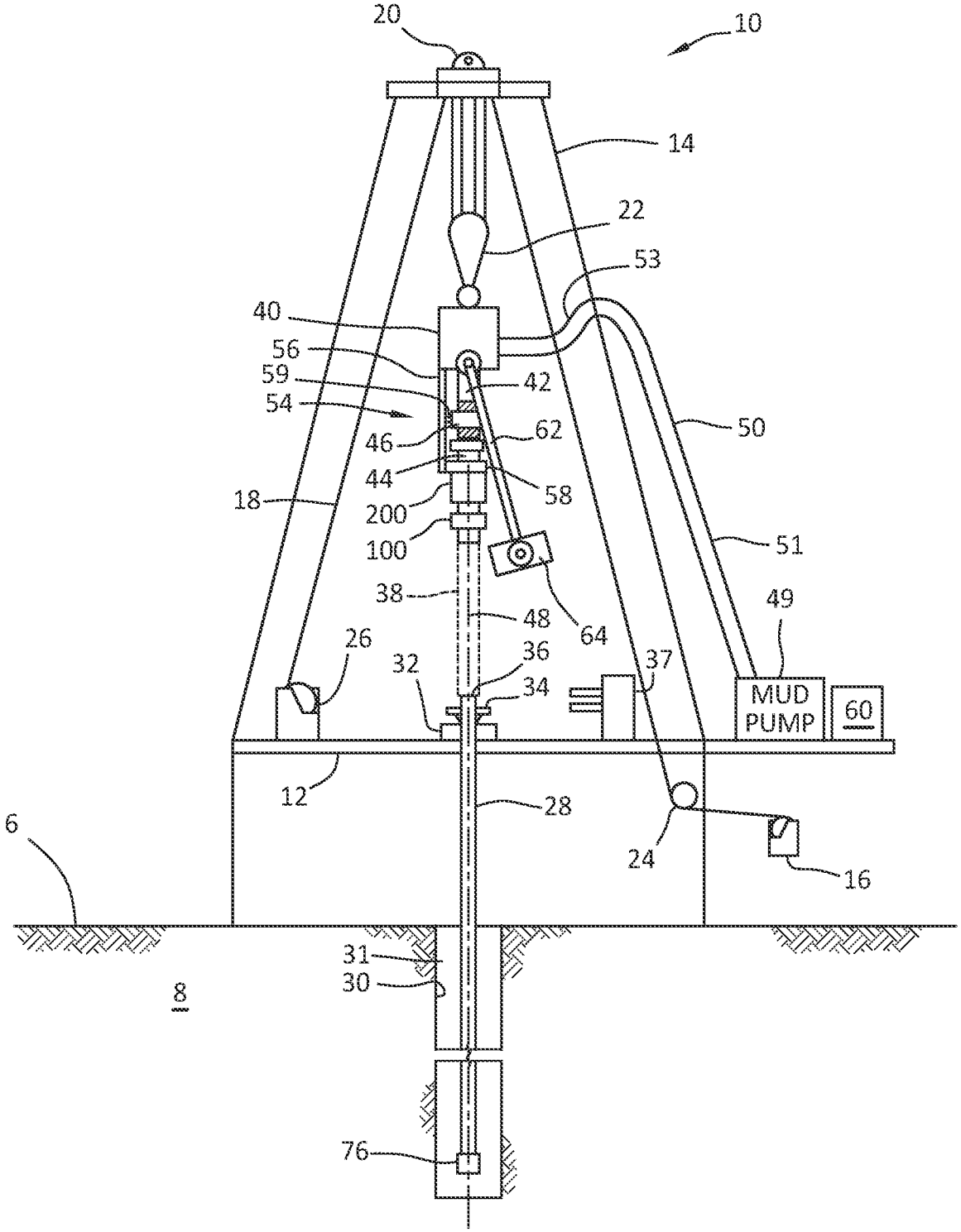
FIG. 1 is a representative partial cross-sectional view of a rig using a top drive to run a tubular string during a subterranean operation, in accordance with certain embodiments.

Turning now to the drawings, FIG. 1 is a schematic of a drilling rig 10 in the process of drilling a well, in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a tubular string 28 extends downward into a wellbore 30 and can be held stationary with respect to the rig floor 12 by a rotary table 32 or slips 34. A portion of the tubular string 28 extends above the rig floor 12, forming a stickup (or stump) 36 to which another length of tubular 38 may be added.

When a new length of tubular 38 is added to the tubular string 28, a pipe handler (not shown) can position the tubular 38 over the stickup 36 in alignment with the center axis 48 of the tubular string 28 and connect the new tubular 38 to the stickup 36. A top drive 40, raised and lowered by a traveling block 22, can be lowered to engage with the top of the tubular 38. The top drive 40 can utilize a grabber system 54 to hold the tubular 38 while the top drive 40 is coupled to the tubular. The grabber system 54 may include a positioner 56 coupled to the top drive 40, a backup wrench 58 coupled to the end of the positioner 56 and configured to grab the tubular 38, and an instrumented sub support 59 configured to couple an instrumented sub 46 to the positioner 56.

The pivot joint 200 can be coupled to a running tool 100, which can be engaged with a tubular 38. The tubular 38 can then be lowered to engage the stickup 36 and the top drive 40 may rotate the tubular 38 to connect the tubular 38 to the tubular string 28 (e.g., a casing string). Specifically, the top drive 40 can include a quill 42, an instrumented sub 46, and a sub 44 (e.g., a crossover sub) to turn the pivot joint 200 and thus the tubular 38. The tubular 38 may be coupled to the pivot joint 200, which can be coupled to the sub 44 and the instrumented sub 46, which in turn can be coupled to the top drive 40 via the quill 42. In certain embodiments, the instrumented sub 46 may include threads on both axial ends to couple to the sub 44 and the quill 42.

Furthermore, the top drive 40 can couple with the tubular 38 in a manner that enables translation of motion to the tubular 38. Indeed, in the illustrated embodiment, the top drive 40 is configured to supply torque for making-up and breaking out a coupling between the tubular 38 and the stickup 36. However, torque for making-up and breaking out a coupling between the tubular 38 and the stickup 36 can alternatively, or in addition to, be supplied by other equipment, such as a pipe handler (not shown) or an iron roughneck (not shown).

To facilitate the circulation of mud or other drilling fluid within the wellbore 30, the drilling rig 10 includes a mud pump 49 configured to pump mud or drilling fluid up to the top drive 40 through a mud hose 50. In certain embodiments, the mud hose 50 may include a standpipe 51 coupled to the derrick 14 in a substantially vertical orientation to facilitate pumping of mud. The standpipe 51 provides a high-pressure path for mud to flow up the derrick 14 to the top drive 40. From the mud hose 50 (e.g., standpipe 51), the mud flows through a Kelly hose 53 to the top drive 40. From the top drive 40, the drilling mud will flow through internal passages of the instrumented sub 46 and the pivot joint, into internal passages of the tubular 38 and the tubular string 28, and into the wellbore 30 at the bottom of the well. The drilling mud flows within the wellbore 30 (e.g., in an annulus 31 between the tubular string 28 and the wellbore 30) and back to the surface where the drilling mud may be recycled (e.g., filtered, cleaned, and pumped back up to the top drive 40 by the mud pump 49).

When a new length of tubular 38 is to be added to the tubular string 28, mud flow from the mud pump 49 and the mud hose 50 can be stopped, and the top drive 40 decoupled from the tubular string 28 (i.e., the length of the tubular 38 that was most recently added to the tubular string 28). When the top drive 40 releases the tubular string 28, mud within the top drive 40 may run out of the top drive 40 and onto the rig floor 12. To avoid spilling mud onto the rig floor 12, the instrumented sub 46 can be included to block mud from inadvertently flowing out of the top drive 40 when the mud pump 49 is not pumping mud. When the top drive 40 is thereafter coupled to a new length of tubular 38 and the mud pump 49 resumes a pumping operation, the instrumented sub 46 may enable flow of mud through the instrumented sub 46 and the top drive 40 to the tubular 38 and tubular string 28. A rig controller 60 can be used to control the subterranean operation, by controlling mud flow through the top drive 40 and tubular string 28, controlling top drive operation, and receiving sensor data from various sensors. The tubular string 28 can include a bottom hole assembly BHA that can include a drill bit used to extend the wellbore 30 through the surface 6 and into the formation 8, or as in a casing string, it can include a float shoe 76 for cementing operations.

In a non-limiting embodiment, the rig 10 may be manipulating a casing string (e.g., the tubular string 28) with a running tool (RT) 100 to lift or lower a tubular 38 (or tubular string 28) during the subterranean operations (e.g., running a casing string). It should be understood that the RT 100 can also be used for tubular strings 28 other than a casing string. A pair of links 62 can be used to suspend an elevator 64 from the top drive 40, but the elevator 64 (as shown) can be rotated out of the way from the tubular string when the pivot joint 200 is being used.

The pivot joint 200 (described in more detail below) can be used, along with the RT 100 to collect a tubular 38 from a pipe handler (e.g., catwalk) and lift it to be vertically positioned over the stickup 36. The top drive 40 (via the traveling block) can be lowered to lower the tubular 38 onto the stickup 36. The top drive 40 can operate the RT 100 to engage the tubular 38, such as by sending hydraulic or electrical signals to the RT 100 to radially expand the RT 100 within the tubular 38. The RT 100 can then rotate the tubular 38 to couple the tubular 38 to the stickup 36. The top drive 40 can then be lowered to lower the tubular string 28 further into the wellbore 30 until the tubular string 28 is at the correct stickup height. The top drive 40 can then disengage the RT 100 from the tubular 38 and engage a new tubular 38 (e.g., from the catwalk). The top drive 40 can then be raised to an appropriate height to repeat the process to add the new tubular 38 to the tubular string 28.

FIGS. 2-8 are representative perspective views of rig components in various stages of running a tubular string 28 into a wellbore 30, in accordance with certain embodiments. The derrick 14 and various other rig components are not shown for clarity. These figures include a top drive 40 that can be raised and lowered (arrows 96) via a traveling block 22 (not shown here) coupled to hoist supports 43. In a non-limiting embodiment, a mud saver valve can be coupled to the quill 42. The mud saver valve is shown encircled by a valve actuator 160 that can be used to actuate the mud saver valve. The instrumented sub 46 can be coupled to an optional sub 44, which can be coupled to a rotary manifold 250, or the instrumented sub 46 can be coupled directly to the rotary manifold 250 without a sub 44.

A pivot joint 200 can be coupled between the rotary manifold 250 and the RT 100, which is used to engage/disengage a tubular 38 or tubular string 28 via the gripper end 104. The RT 100 is shown as an internal RT 100, which refers to a RT 100 that inserts the gripper end 104 into the tubular 38 (or tubular string 28) to engage the internal surfaces of the tubular 38. However, it should be understood that an external RT 100 can be used to engage/disengage the tubular by inserting the tubular inside the gripper end 104 with the gripper end 104 surrounding the top end of the tubular 38 and the gripper end 104 engaging the external surface of the tubular 38. Therefore, any description in this disclosure regarding the RT 100 can equally apply to an internal RT 100 or an external RT 100, except where the attachment means to the tubular 38 is different. The pivot joint 200 can include an upper portion 202 and a lower portion 204 which are pivotably attached to each other at the pivot 206. The pivot joint 200 can also include one or more actuators 210, 212 to pivot the upper portion 202 and lower portion 204 relative to each other around the pivot 206. The actuators 210, 212 may be mechanically, hydraulically, or electrically operated.

Figure 2:
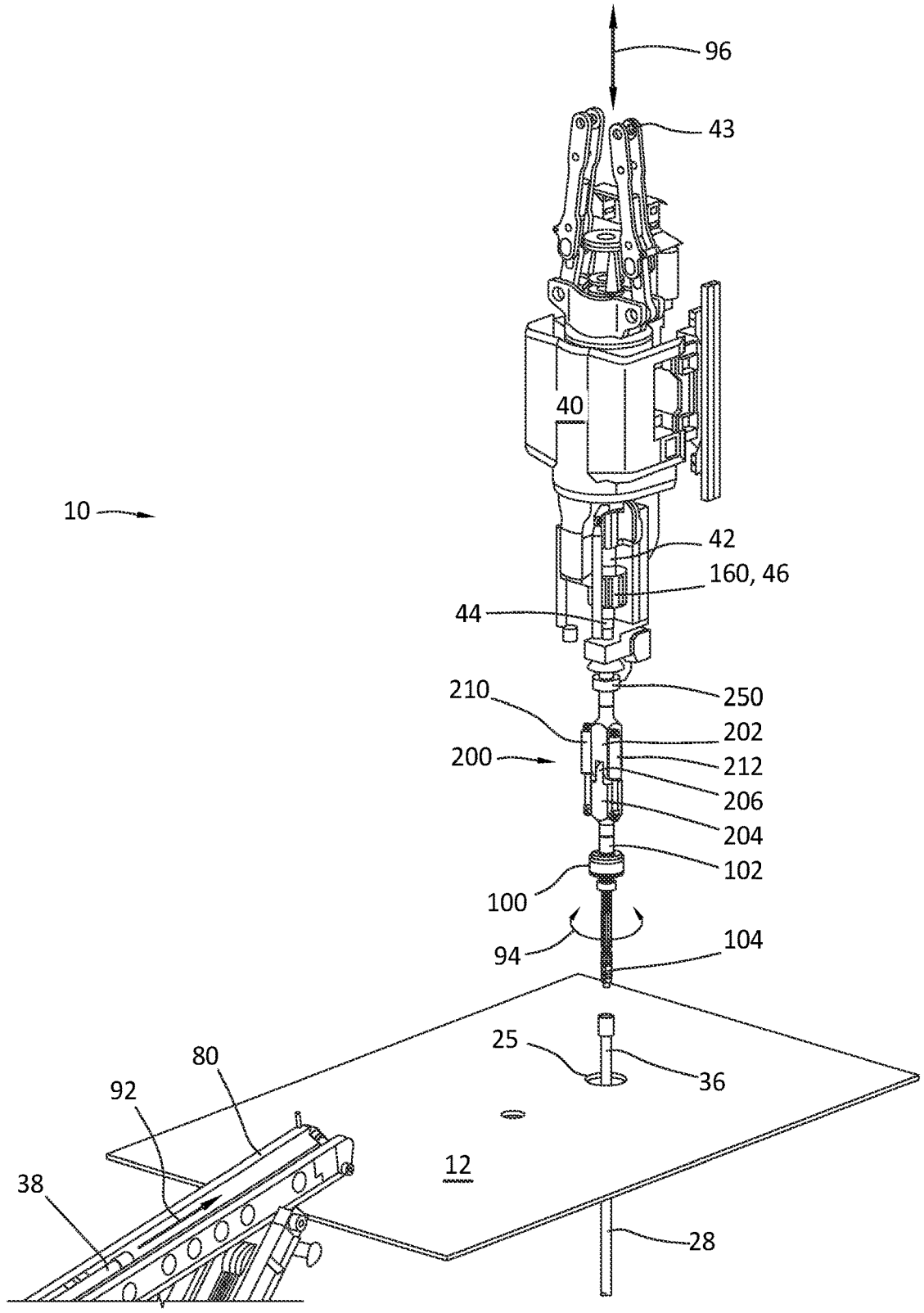
FIGS. 2-8 are representative perspective views of rig components in various stages of running a tubular string into a wellbore, in accordance with certain embodiments.

Referring to FIG. 2, the RT 100 has just been disengaged from the tubular string 28 and pulled out of the stickup 36, in accordance with certain embodiments. The top drive 40 can position the RT 100 to collect another tubular 38 from the catwalk 80. Since the rotation of the top drive 40 during make-up of a previous tubular joint may have not resulted in the pivot joint 200 being at a desired azimuthal orientation to receive the tubular 38 from the catwalk 80, the top drive 40 can rotate the sub 44 (arrows 94) to prepare for receiving the tubular 38. The tubular 38 can be moving up the catwalk 80 toward the well center 25 (arrows 92) and the pivot joint 200 can be actuated to pivot the RT 100 to an angle at which the tubular 38 from the catwalk 80 can cause the gripper end 104 to enter the end of the tubular 38.

Figure 3:
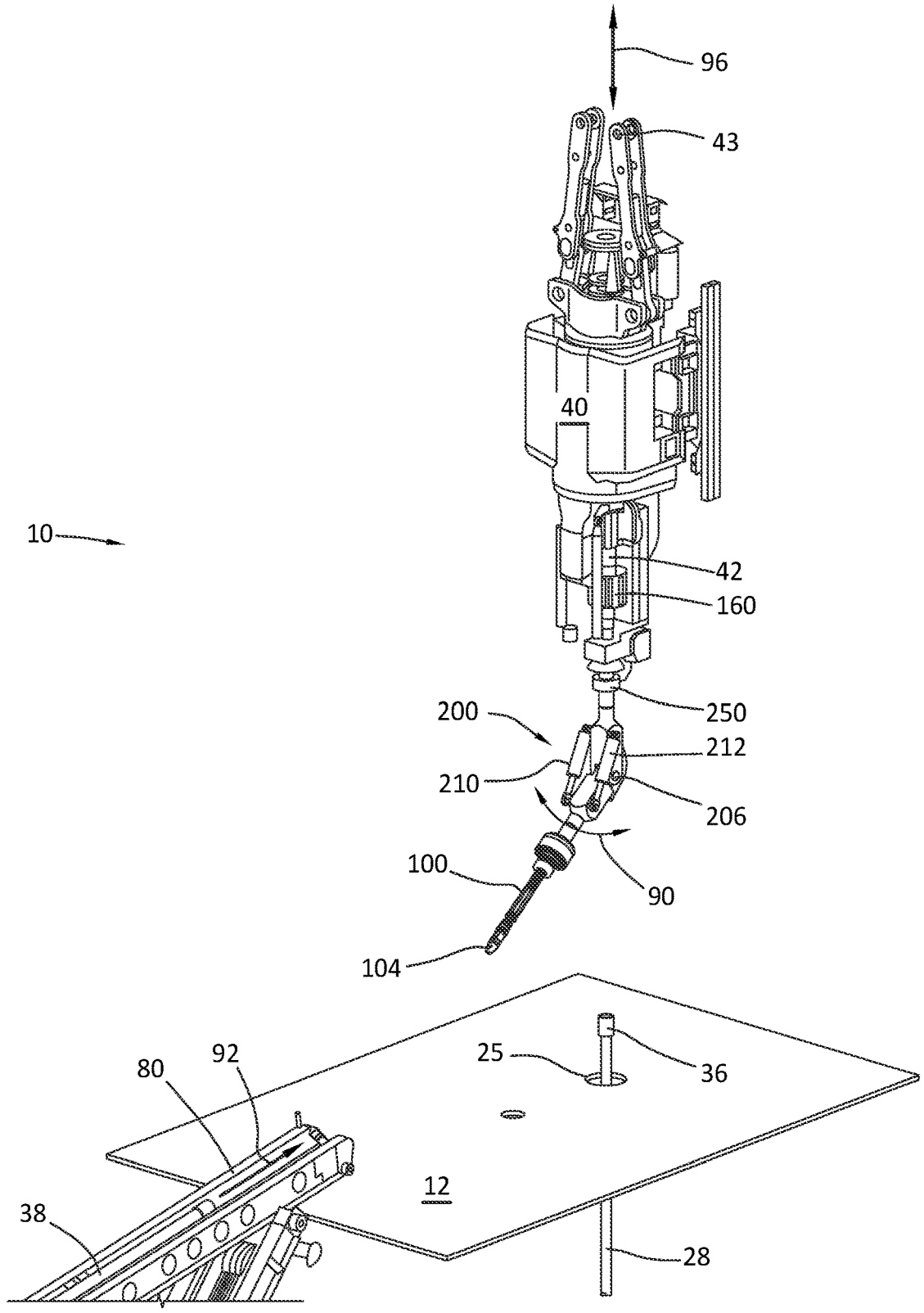

Referring to FIG. 3, the pivot joint 200 has been pivoted (arrows 90) from its vertical position by actuators of the pivot joint 200, in accordance with certain embodiments. The tubular 38 can continue to advance along the catwalk 80 towards the RT 100 while the pivot joint 200 further pivots the RT 100 to align with the tubular 38.

Figure 4:
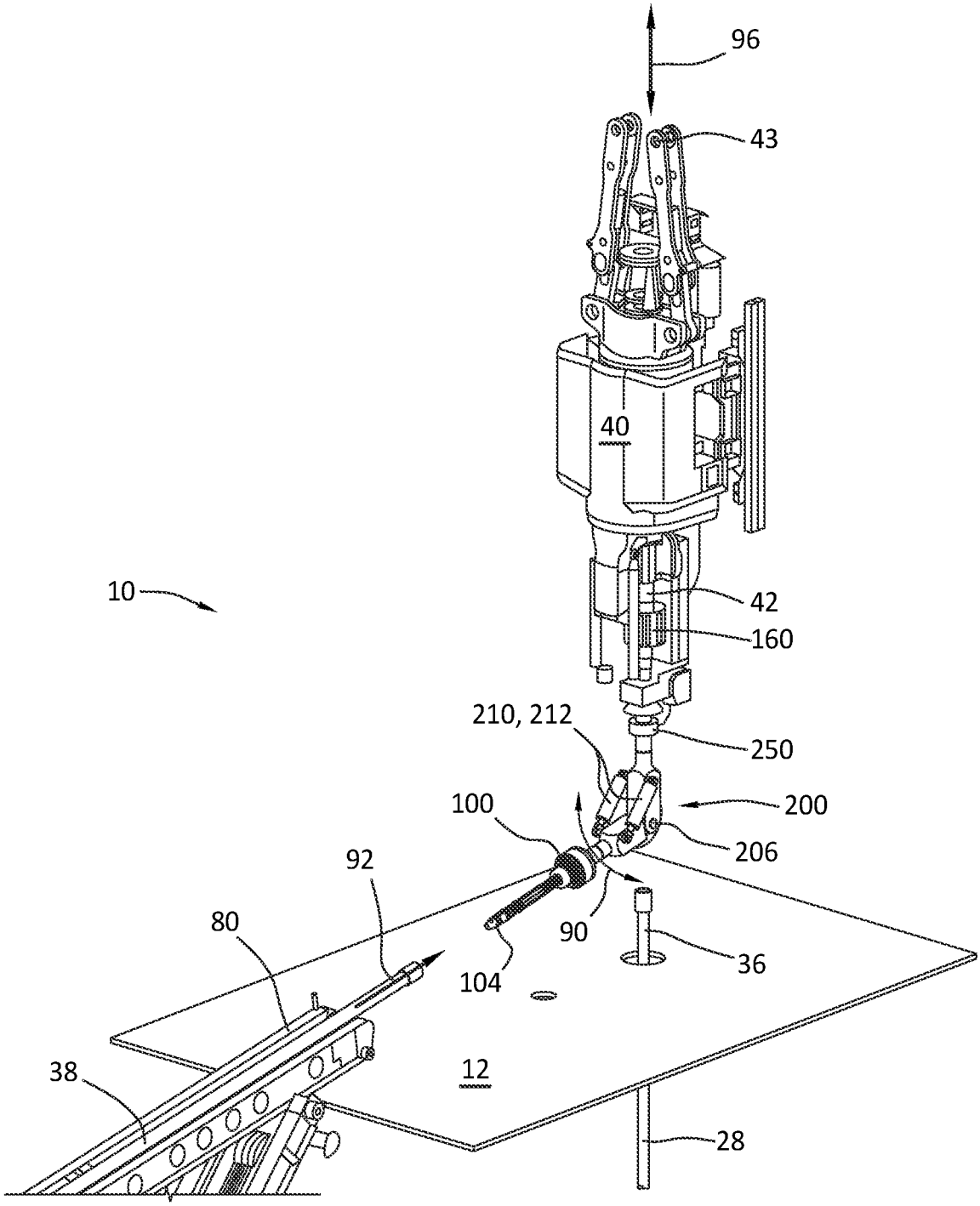

Referring to FIG. 4, the RT 100 is positioned to receive the tubular 38 from the catwalk 80, in accordance with certain embodiments. The RT 100 has been rotated via the quill 42 to a required azimuthal position about the center axis of the quill (axis 89), the RT 100 has been pivoted from a vertical orientation to a desired angle, and the top drive 40 has been lowered a desired amount to align the RT 100 with the tubular 38 on the catwalk 80. These movements can be performed in any order as desired to align the RT 100 with the tubular 38 on the catwalk 80.

Figure 5:
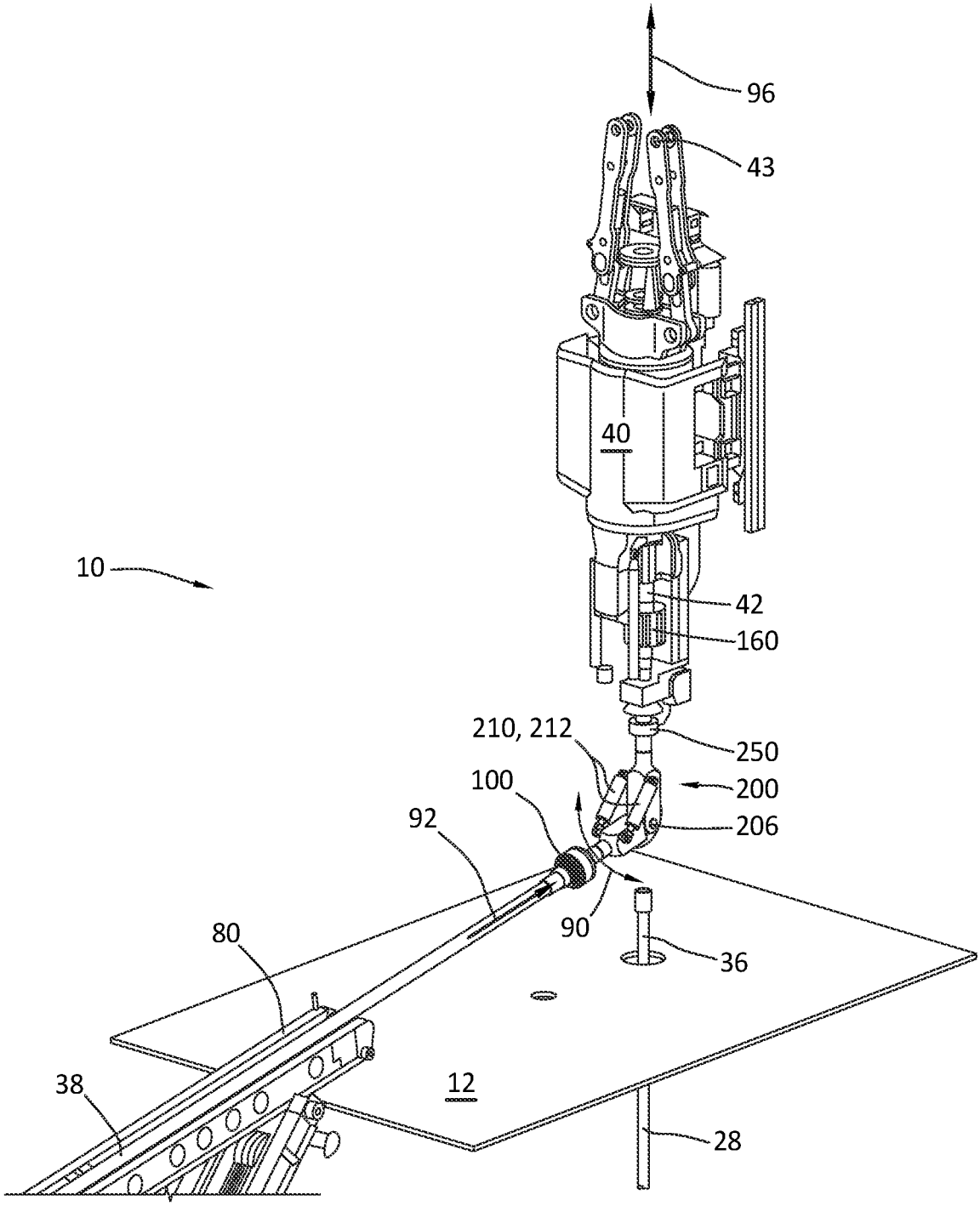

Referring to FIG. 5, the tubular 38 can be advanced from the catwalk 80 such that it receives the gripper end 104 of the RT 100 into the tubular 38, in accordance with certain embodiments. The gripper end 104 can then be actuated to engage the tubular 38 in preparation of lifting the tubular 38 from the catwalk 80.

Figure 6:
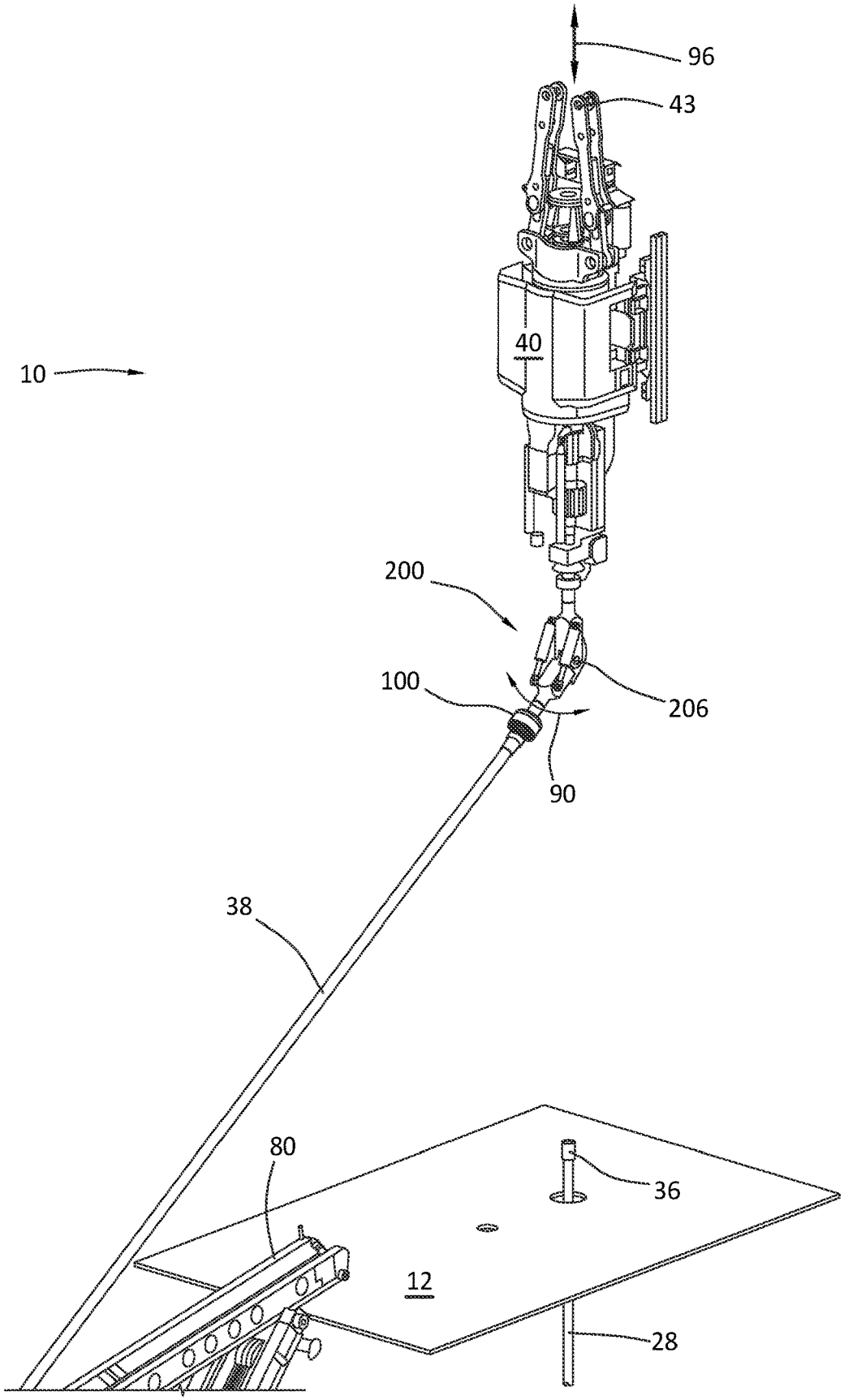

Referring to FIG. 6, when the gripper end 104 is engaged with the tubular 38, the top drive 40 can be hoisted, via the hoist supports 43, thereby raising the end of the tubular 38 that is engaged with the RT 100 from the catwalk 80, in accordance with certain embodiments. The opposite end of the tubular 38 can continue to slide along the catwalk 80 while the top drive 40 is being raised. The pivot joint 200 can rotate the RT 100 about the pivot 206 as the top drive is being raised. While the top drive 40 is being raised, the pivot joint actuator(s) 210, 212 can be in a free float mode (i.e., the pivot joint actuator can provide unrestrained pivoting of the pivot joint 200). Once the top drive 40 is hoisted enough to allow the tubular 38 to leave the catwalk 80, the pivot joint actuator(s) 210, 212 may be engaged again to control the swinging of the tubular 38 when pivoting the tubular 38 to a vertical orientation.

Figure 7:
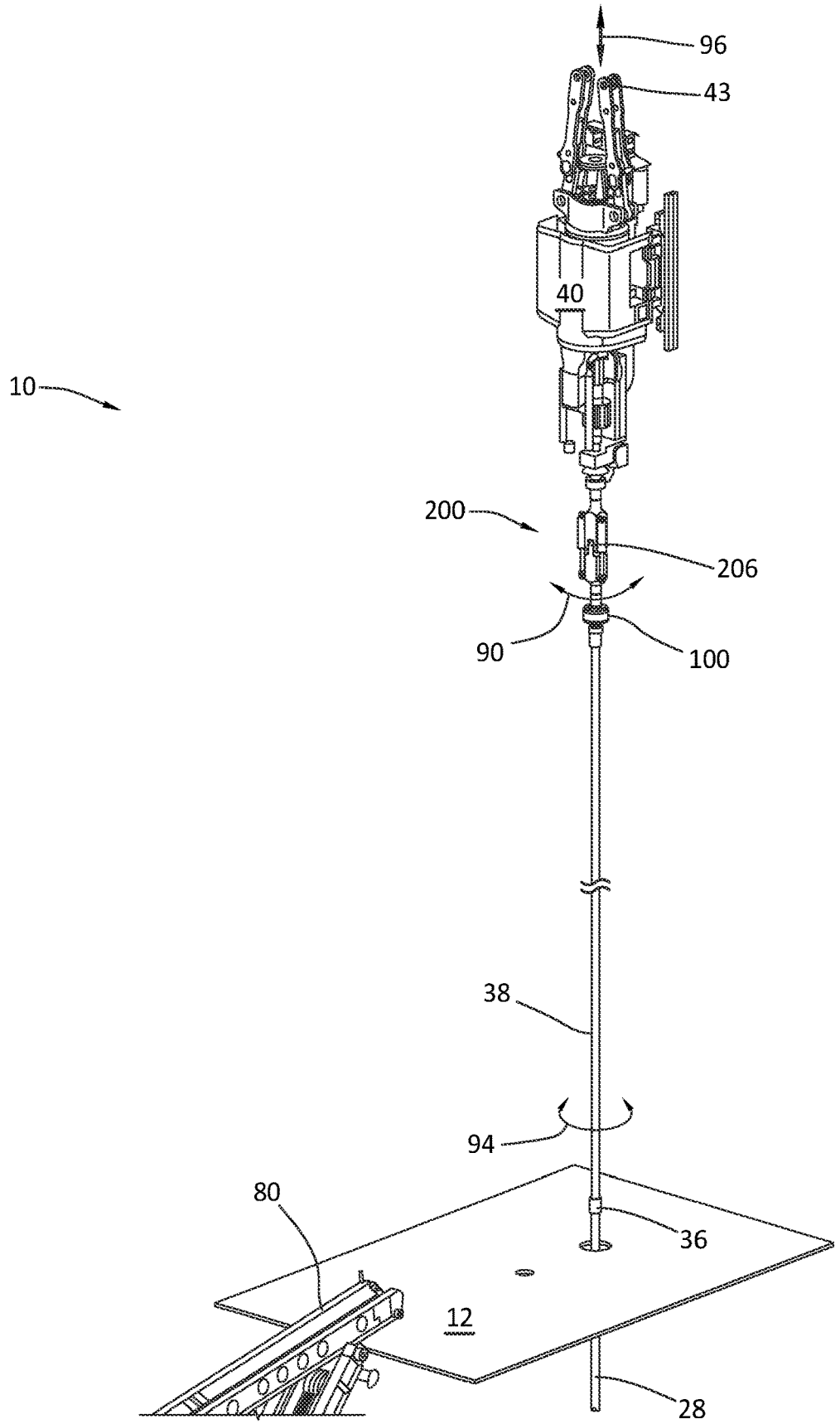

Referring to FIG. 7, when the top drive 40 has been raised a desired distance such that the tubular 38 is in a vertical orientation above the stickup 36, then the top drive can be lowered to cause the tubular 38 to engage the stickup 36 and then make-up the tubular joint between the tubular 38 and the tubular string 28 (i.e., thread the tubular 38 to the stickup 36 and torque the resulting tubular joint).

Figure 8:
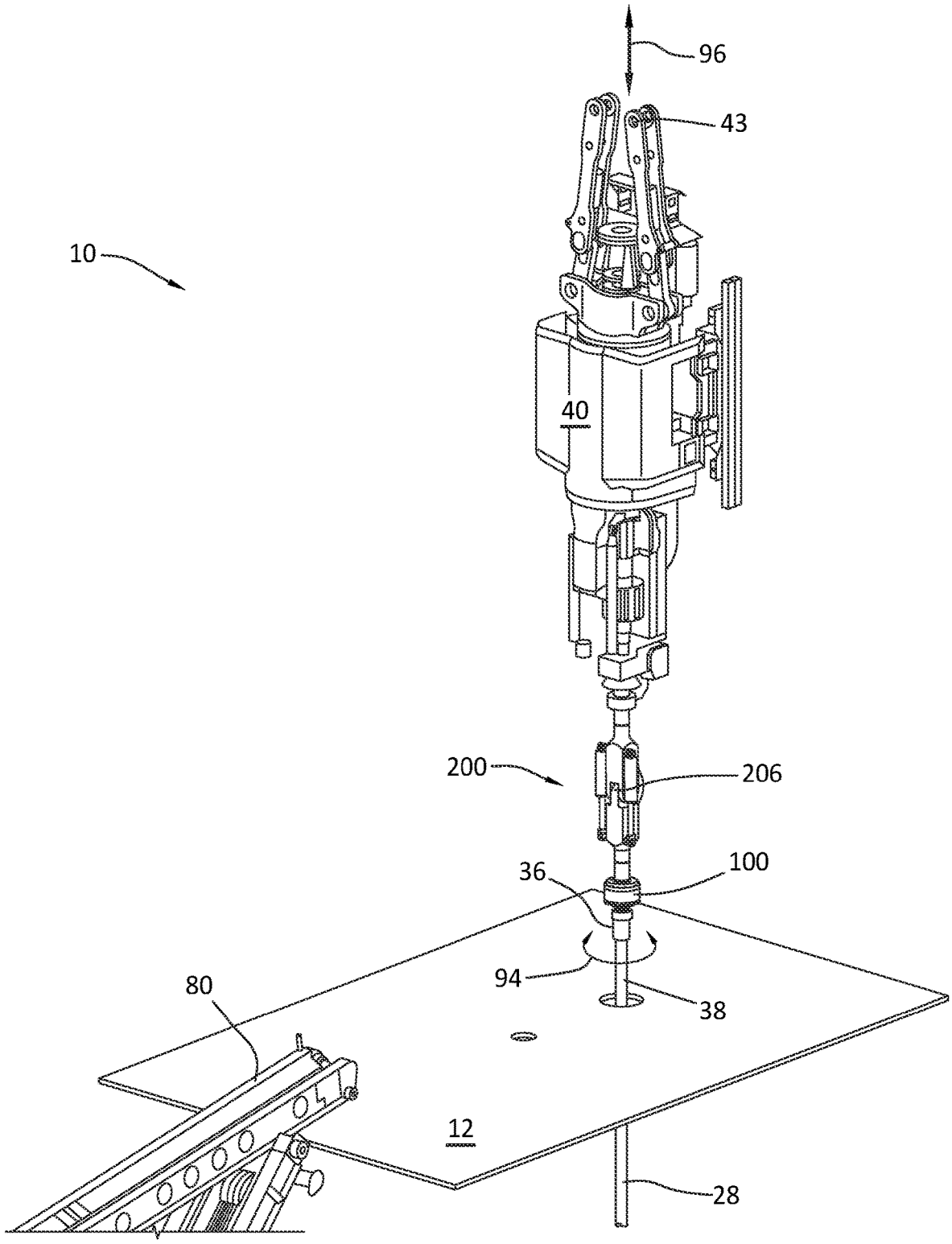

Referring to FIG. 8, when the tubular joint is made-up, the top drive 40 can then be lowered to extend the tubular string 28 into the wellbore 30 until the top of the tubular 38 is at a desired stickup height to form the stickup 36, in accordance with certain embodiments. The RT 100 can disengage from the tubular 38 (or from the top end of the tubular string 28), be raised out of the tubular 38, and the RT 100 prepared to receive the next tubular 38 from the catwalk (such as in FIG. 2). Then the process (e.g., FIGS. 2-8) can be repeated until the tubular string 28 is extended into the wellbore 30 a desired distance. If the tubular string 28 is being tripped out of the wellbore, then the process described for FIGS. 2-8 can be performed in reverse order to remove at least a portion of the tubular string 28 from the wellbore 30.

Figure 9:
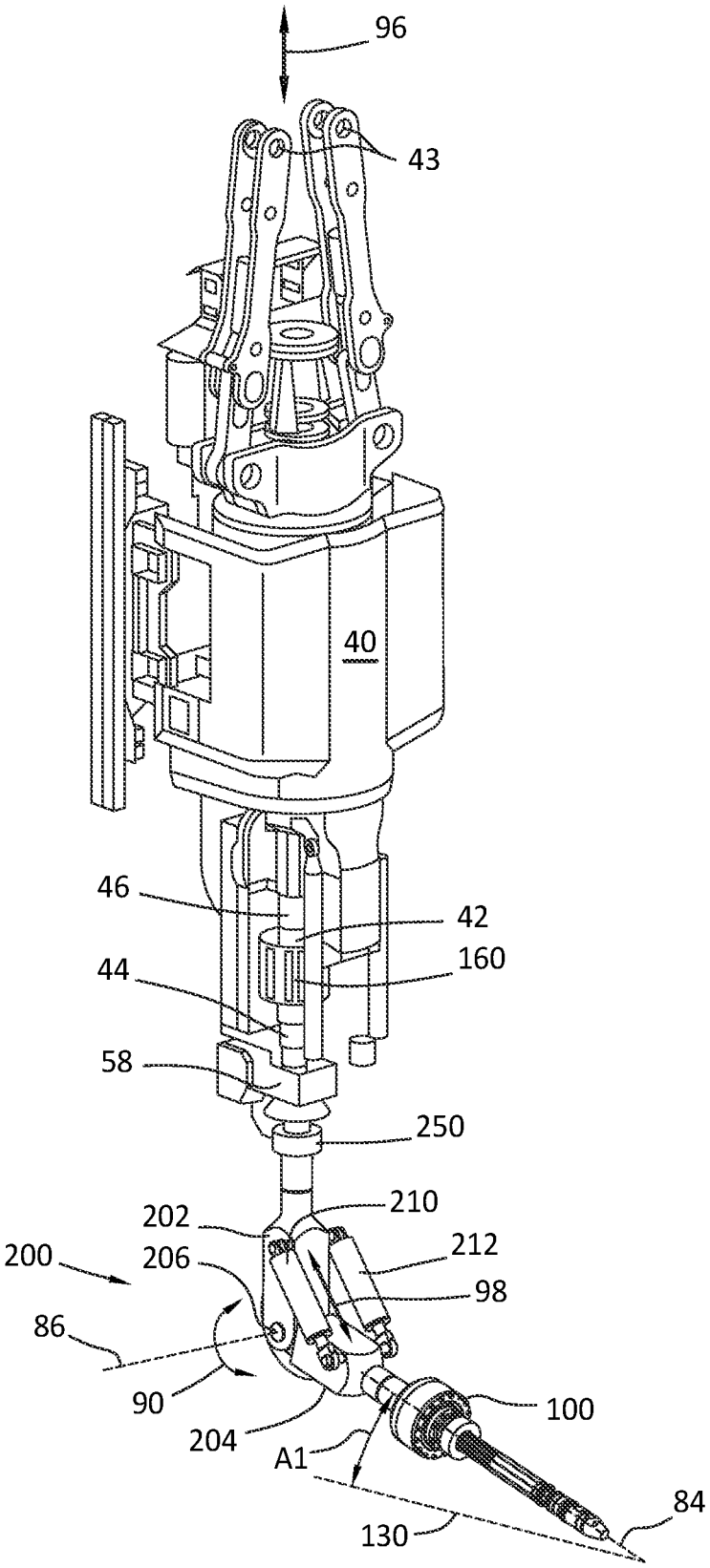
FIG. 9 is a representative perspective view of a top drive with a running tool (RT) pivoted from a vertical orientation to receive a tubular, in accordance with certain embodiments.

FIG. 9 is a representative perspective view of a top drive 40 with a RT 100 pivoted from a vertical position to a position for receiving a tubular 38, in accordance with certain embodiments. An instrumented sub 46 with an internal valve (e.g., a mud saver valve 46, an internal blowout preventer valve, etc.) can be coupled to the quill 42 of the top drive 40. A valve actuator 160 can be used to remotely operate the internal valve. A sub 44 can be coupled between the instrumented sub 46 and a rotary manifold 250. The rotary manifold 250 includes a stationary portion that is rotationally fixed to the backup wrench 58 of the top drive 40 and a rotary portion that is configured to rotate relative to the stationary portion and the top drive 40. The rotary portion of the rotary manifold 250 can be coupled to a pivot joint 200 at the upper portion 202 with the RT 100 coupled to a lower portion 204 of the pivot joint 200.

The upper and lower portions 202, 204 of the pivot joint 200 are pivotably coupled to each other by pivot 206, which allows the lower portion 204 to be rotated about the axis 86 of the pivot 206. The upper portion 202 is fixedly coupled with the rotary portion of the rotary manifold 250, therefore, the pivot joint 200 will rotate with the quill 42. One or more actuators 210, 212 can be rotationally coupled between the upper and lower portions 202, 204, such that when the one or more actuators 210, 212 are retracted (arrows 98), the lower portion 204 will rotate upward about the axis 86 of the pivot 206 and when the one or more actuators 210, 212 are extended (arrows 98), the lower portion 204 will rotate downward about the axis 86 of the pivot 206 toward a vertical orientation.

Since the RT 100 is coupled to the lower portion 204, then the RT 100 will be rotated about the axis 86 of the pivot 206 to any position between a vertical orientation and a horizontal position. It should be understood that the RT 100 can be configured to rotate upward more than 90 degrees from the vertical orientation. However, it is preferable to rotate the RT 100 upward to an orientation that matches a presentation angle (e.g., angle A1) of the tubular 38 from the catwalk 80. Reference line 130 represents a line parallel with the rig floor 12. Therefore, that angle A1 generally represents the presentation angle of the tubular 38 from the catwalk 80. When the tubular 38 is extended from the catwalk to receive the RT 100, control lines from the rotary manifold 250 can be used to remotely actuate the RT 100 to engage the tubular 38. Once engaged with the tubular 38, the top drive 40 can raise the RT 100 and the tubular 38, with the RT 100 pivoting back to the vertical orientation at which the tubular 38 can be lowered into engagement with the stickup 36.

Figure 10:
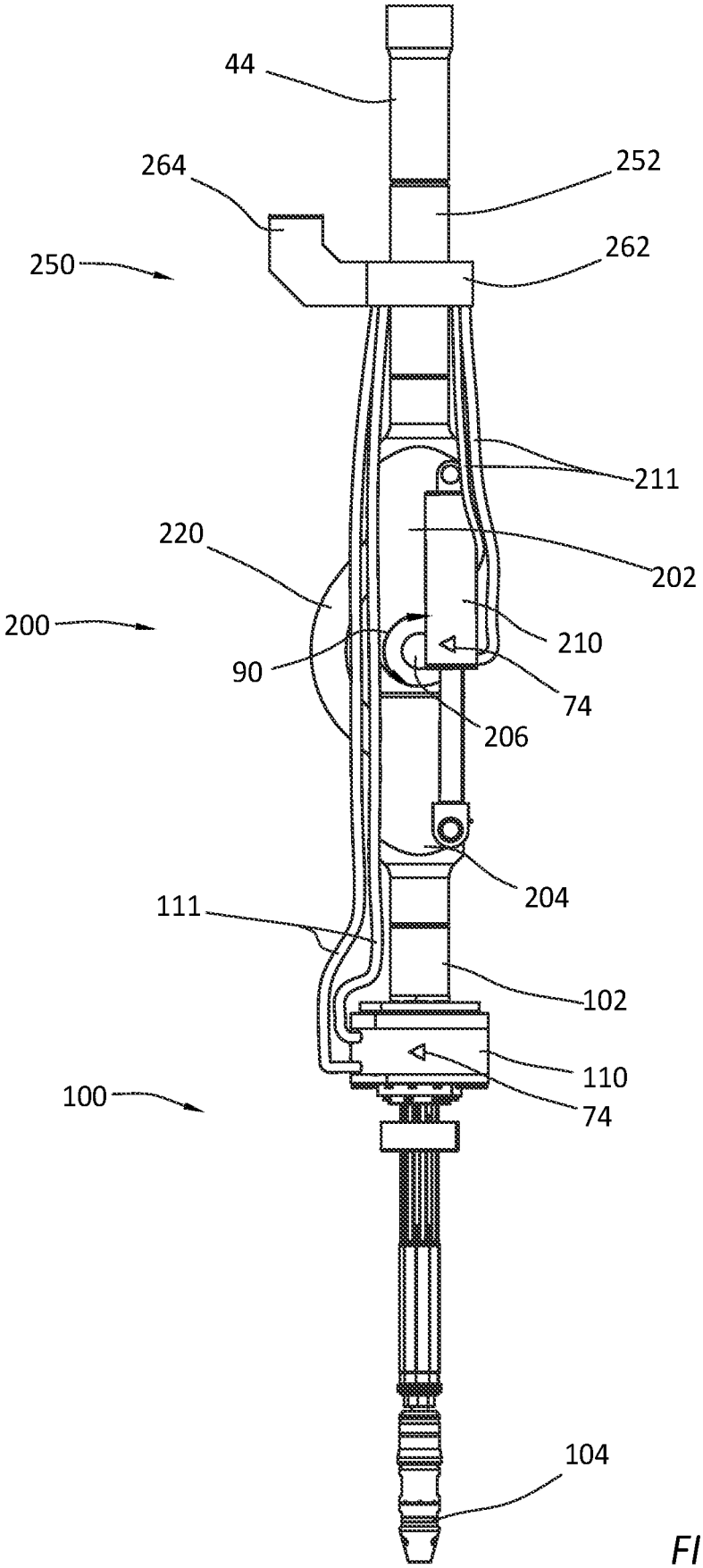
FIG. 10 is a representative side view of a pivot joint coupled between a sub and a RT, with the pivot joint fully extended, in accordance with certain embodiments.

FIG. 10 is a representative side view of a pivot joint 200 coupled between a sub 44 and a RT 100, with the pivot joint 200 fully extended, such that a center axis of the flow passage through the RT is generally aligned with a center axis of the flow passage through the rotary manifold 250, in accordance with certain embodiments. The rotary manifold can include a rotary portion 252 and a stationary portion 262. The rotary portion 252 can rotate with the quill 42 and the sub 44 (if used). The stationary portion 262 is rotationally fixed to the backup wrench 58 via the manifold support 264.

Control signals from a rig controller 60 or other controller (e.g., in an instrumented sub 46) can be coupled to the rotary portion 252 from the stationary portion 262 via a rotary hydraulic manifold (e.g., for hydraulic control of the pivot joint 200 and RT 100) or via inductive couplings or a slip ring in the rotary manifold 250 (e.g., for electrical control of the pivot joint 200 and RT 100) or a combination thereof. Control signals (e.g., hydraulic or electric) can be communicated to the RT 100 via one or more control lines 111 from the rotary manifold 250. These control lines 111 can be used to remotely operate the RT 100 to engage or disengage a tubular 38 (or tubular string 28).

Control signals (e.g., hydraulic or electric) can be communicated to the pivot joint 200 via one or more control lines 211, 213 from the rotary manifold 250. These control lines 211, 213 can be used to remotely operate the respective actuators 210, 212 to rotate the lower portion 204 (arrows 90) of the pivot joint 200 relative to the upper portion 202 about the axis 86 of the pivot 206. The flexible conduit 220 can provide a flow passage 222 for fluid (e.g., drilling fluid) to flow between the upper portion 202 and the lower portion 204 of the pivot joint 200 past the pivot 206. The flexible conduit 220 can accommodate rotation of the lower portion 204 relative to the upper portion 202 while maintaining fluid flow between the top drive 40 and the RT 100.

The control lines 111, 211, 213 can also be used to communicate sensor data from one or more sensors 74 (disposed in the pivot joint 200 or the RT 100) to the rig controller 60 via the rotary manifold 250. The sensors 74 can collect parameters for the RT 100 (e.g., state of the RT 100 actuator 110, temperature, pressure, confirmation of engagement or disengagement of the gripper end 104, etc.) or parameters for the pivot joint 200 (e.g., orientation of the lower portion 204 relative to the upper portion 202, extension length of either of the actuators 210, 212, temperature, pressure, etc.) and communicate these operational parameters to the rig controller 60 via the rotary manifold 250. In a non-limiting embodiment, the sensors 74 can be linear variable displacement transformer (LVDT) sensors, radial variable differential transformer (RVDT) sensors, proximity sensors, or any other suitable sensor for determining the position of the actuators 210, 212 or the radial position about the pivot 206 of the lower portion 204 relative to the upper portion 202, or any other suitable sensor for determining the radial position of the pivot joint 200 about the quill's center axis 89.

Figure 11:
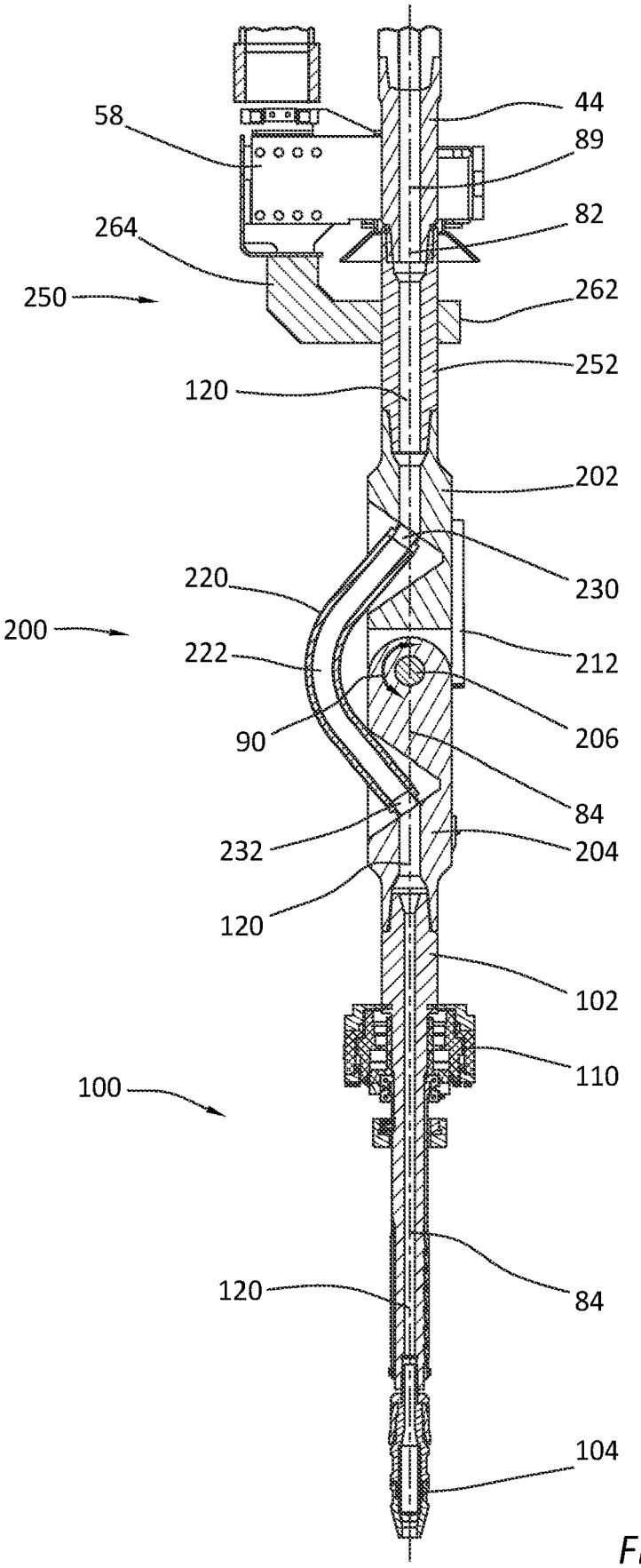
FIG. 11 is a representative partial cross-section view a pivot joint coupled between a sub and a RT, with the pivot joint fully extended, in accordance with certain embodiments.

In a non-limiting embodiment, FIG. 11 is a representative partial cross-section view a pivot joint 200 coupled between a sub 44 and a RT 100, with the pivot joint 200 fully extended. The stationary portion 262 of the rotary manifold 250 can be rotationally fixed to the backup wrench 58 via the manifold support 264. The rotary portion 252 of the rotary manifold 250 can be coupled between the sub 44 and the upper portion 202 of the pivot joint 200. The lower portion 204 of the pivot joint 200 can be coupled to the top end 102 of the RT 100, with the lower end of the RT 100 being selectively engaged with a tubular 38.

A flow passage 120 can extend through the assembly shown in FIG. 11 to allow fluid flow from the top drive 40 (not shown), through this assembly in FIG. 11 and into the tubular string 28 via the coupling of the RT 100 to a tubular 38 connected to the tubular string 28. A flexible conduit 220 which is coupled to the upper portion of the flow passage 120 via the upper coupling 230 and coupled to the lower portion of the flow passage 120 via the lower coupling 232 provides a flow path past the pivot 206 for the fluid (e.g., drilling fluid). As the lower portion 204 is rotated about the pivot 206, the flexible conduit can flex to allow the rotation while maintaining a fluid flow path (i.e., the flow passage 120) from the top drive 40 to the RT 100.

Figure 12:
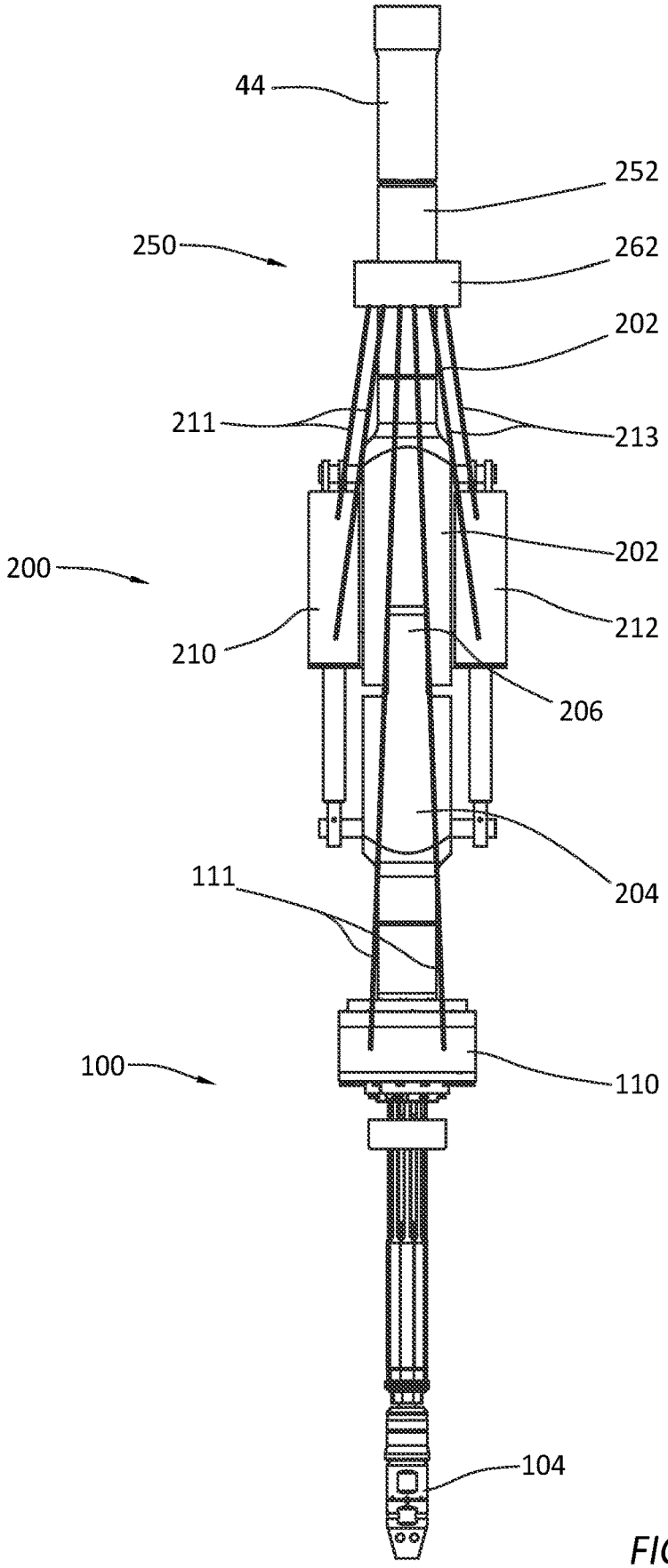
FIG. 12 is a representative front view of a pivot joint coupled between a sub and a RT, with the pivot joint fully extended, in accordance with certain embodiments.

FIG. 12 is a representative front view of a pivot joint 200 coupled between a sub 44 and a RT 100, with the pivot joint fully extended, in accordance with certain embodiments. This view more clearly indicates connections of the control lines 111, 211, 213 to the respective actuators 110, 210, 212. However, these control lines can also represent lines for data transmission between a rig controller 60 and the pivot joint 200 or the RT 100 (e.g., to transfer sensor data or receive control commands).

Figure 13:
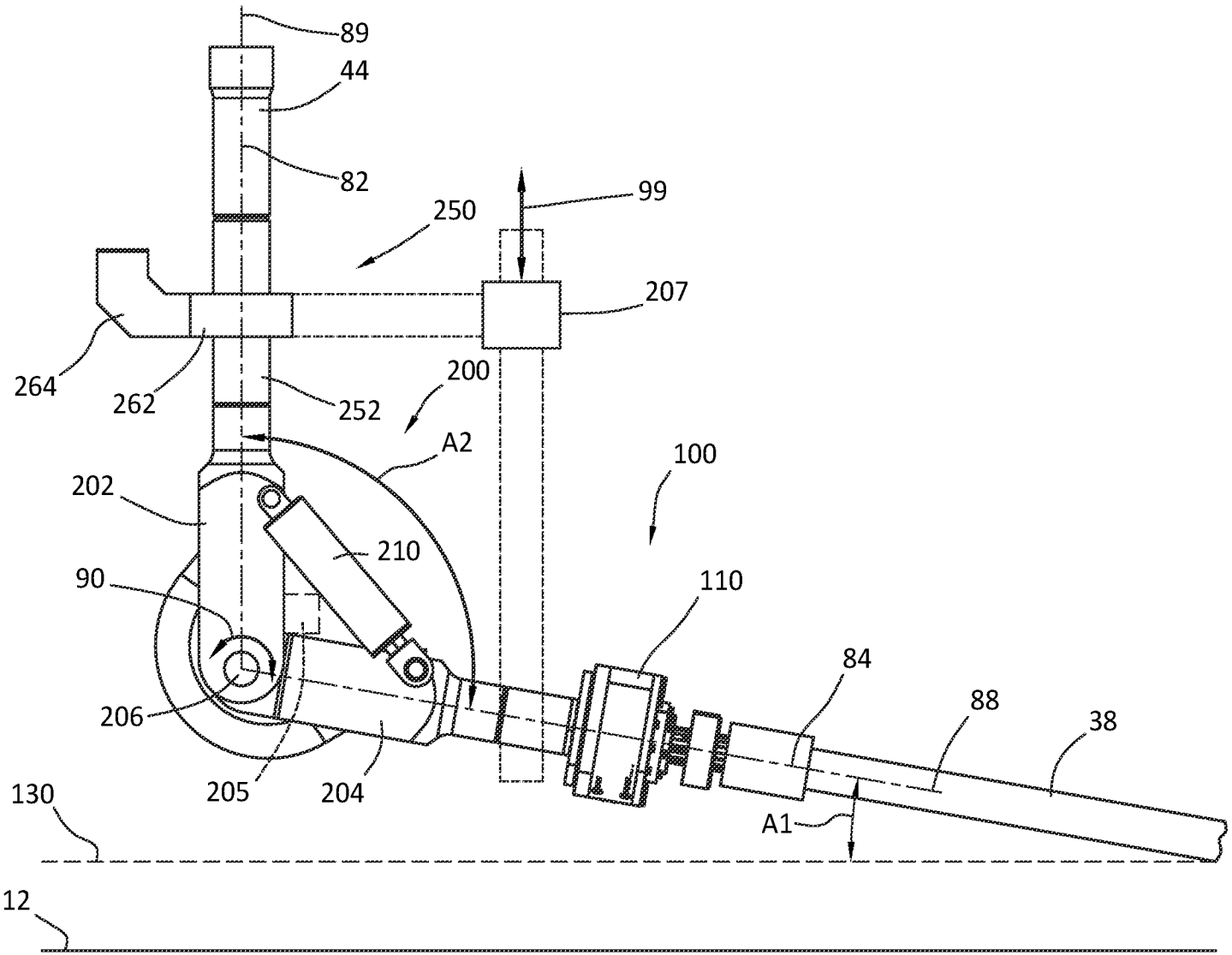
FIG. 13 is a representative side view of a pivot joint coupled between a sub and a RT, with the pivot joint rotated to align the RT with a tubular on a catwalk, in accordance with certain embodiments.

In a non-limiting embodiment, FIG. 13 is a representative side view of a pivot joint 200 coupled between a sub 44 and a RT 100, with the pivot joint 200 rotated to align the center axis 84 of the RT 100 with a center axis 88 of the tubular 38 on a catwalk 80. The actuators 210, 212 have been retracted a desired amount to pivot the RT 100 to the desired angle A1, which can correspond to the angle between the center axis 88 of the tubular 38 on the catwalk 80 and the reference line 130, which is generally parallel to the rig floor 12. As the actuators 210, 212 are retracted the angle A2 between the center axis 82 of the upper portion 202 (or the center axis 89 of the quill) and the center axis 84 of the RT 100 and the lower portion 204 decreases. Angle A2 can range from 60 degrees up to 180 degrees. In certain embodiments, the angle A2 can range from 80 degrees to 180 degrees, or the angle A2 can range from 90 degrees to 180 degrees, or the angle A2 can range from 95 degrees to 180 degrees, or the angle A2 can range from 100 degrees to 180 degrees, or the angle A2 can range from 110 degrees to 180 degrees, or the angle A2 can range from 80 degrees to 185 degrees, or the angle A2 can range from 80 degrees to 190 degrees, or from 60 degrees up to 190 degrees.

A mechanical device 205 or 207 can be used to assist in alignment between the RT 100 and the tubular 38. The mechanical device 205 can be used to set a maximum rotation of the lower portion 204 relative to the upper portion 202 by engaging the lower portion 204 when it is pivoted upward. The mechanical device 205 can be a stop that generally prevents further upward pivoting of the lower portion 204. The stop can be adjustable so that when the pivot joint 200 is being setup on a rig, the portion 204 can be pivoted upward to the correct angle A2 that aligns with the angle A1 of the tubular 38 on the catwalk 80. After the mechanical device 205 is adjusted to the appropriate position, then the lower portion 204 can later be rotated to engage the mechanical device 205 to set the lower portion at the desired angle A2 due to the engagement of the mechanical device 205.

Additionally, a mechanical device 207 can be used to set the RT 100 at the desired azimuthal position relative to the quill's center axis 89. The mechanical device 207 can be rotationally fixed to the top drive 40 (e.g., rotationally fixed to the stationary portion 262 of the rotary manifold 250). And the mechanical device 207 can selectively interfere with rotation of the RT 100 about the quill's center axis 89. Therefore, when it is desired for the mechanical device 207 to be used to orient the RT 100 at the desired azimuthal position, the mechanical device 207 can be moved into the path of rotation of the RT 100 about the quill's center axis 89 to prevent further rotation of the RT 100. When the RT 100 engages the mechanical device 207, then the RT 100 can be at the desired azimuthal position.

The mechanical device 207 can be adjustable so that when the pivot joint 200 is being setup on a rig, the portion 204 can be pivoted upward to the correct angle A2 that aligns with the angle A1 of the tubular 38 on the catwalk 80 and the lower portion 204 along with the RT 100 can be rotated about the quill's center axis 89 until the RT 100 aligns with a tubular 38 on the catwalk 80. The mechanical device 207 can be adjusted to cause the RT 100 to be at the desired azimuthal position when the RT 100 engages the mechanical device 207. When unrestricted rotation of the RT 100 about the quill's center axis 89 is desired, then the mechanical device 207 can be moved out of the path of the RT 100 (e.g., selectively raising or lowering the mechanical device 207 as shown by arrows 99).

In certain embodiments, the angle A1 can range from −30 degrees up to +100 degrees, as well as the associated ranges to the angle A2 above. For example, if A2 is in a range from 60 degrees to 190 degrees, then the associated range of angles for angle A1 should correspond to −30 degrees up to +100 degrees, where "−" negative degrees for A1 refers to an angle below the reference line, and a "+" positive degrees for A1 refers to an angle above the reference line.

Figure 14:
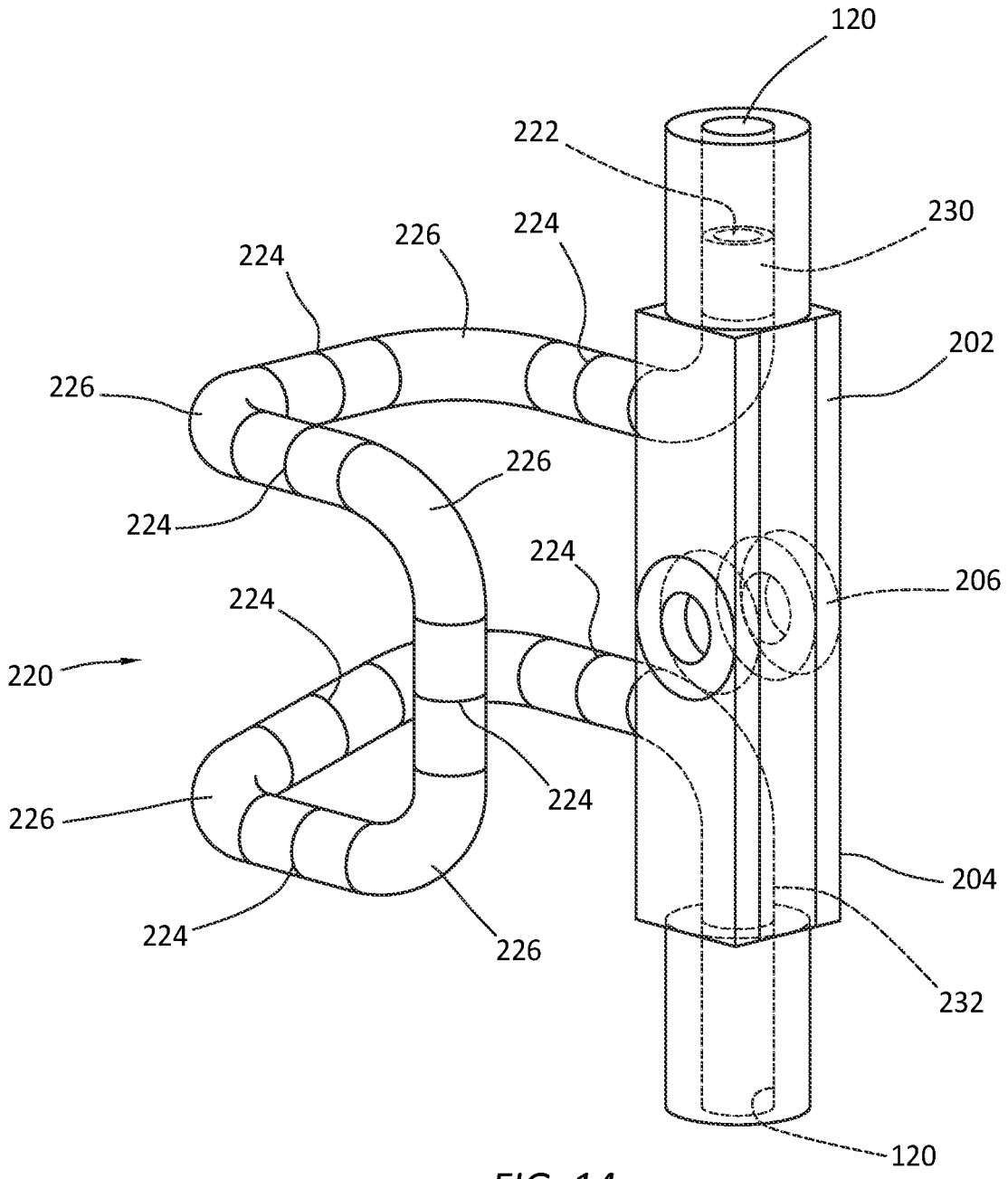
FIG. 14 is a representative perspective view of another pivot joint, with the pivot joint fully extended, in accordance with certain embodiments.

FIG. 14 is a representative perspective view of another pivot joint 200, with the pivot joint 200 fully extended, in accordance with certain embodiments. The pivot joint 200 is similar to the pivot joint 200 of the previous FIGS., except that the flexible conduit 220 is configured differently. In this configuration, the flexible conduit 220 can be formed of multiple swivel joints coupled to adjacent rigid elbows. In a non-limiting embodiment, the flexible conduit 220 can include an elbow 226 (e.g., a 90 degree elbow, a 60 degree elbow, a 45 degree elbow, a 22.5 degree elbow, or combinations of these elbows) coupled to the coupling 230 in the upper portion 202 at one end and to a swivel joint 224 at the other end. Each of the multiple swivel joints 224 can couple adjacent pairs of elbows 226 together to form the flexible conduit 220 with the end elbow 226 being coupled to the coupling 232 in the lower portion 204.

The flexible conduit 220 provides a bypass flow passage 222 for diverting fluid from the flow passage 120 of the upper portion 202 to the flow passage 120 of the lower portion 204, thereby bypassing the pivot 206. The plurality of swivel joints 224 allows the flexible conduit to adapt to a shape that enables the lower portion 204 to rotate relative to the upper portion 202 about the pivot 206 while maintaining a flow passage through the pivot joint 200.

Figure 15:
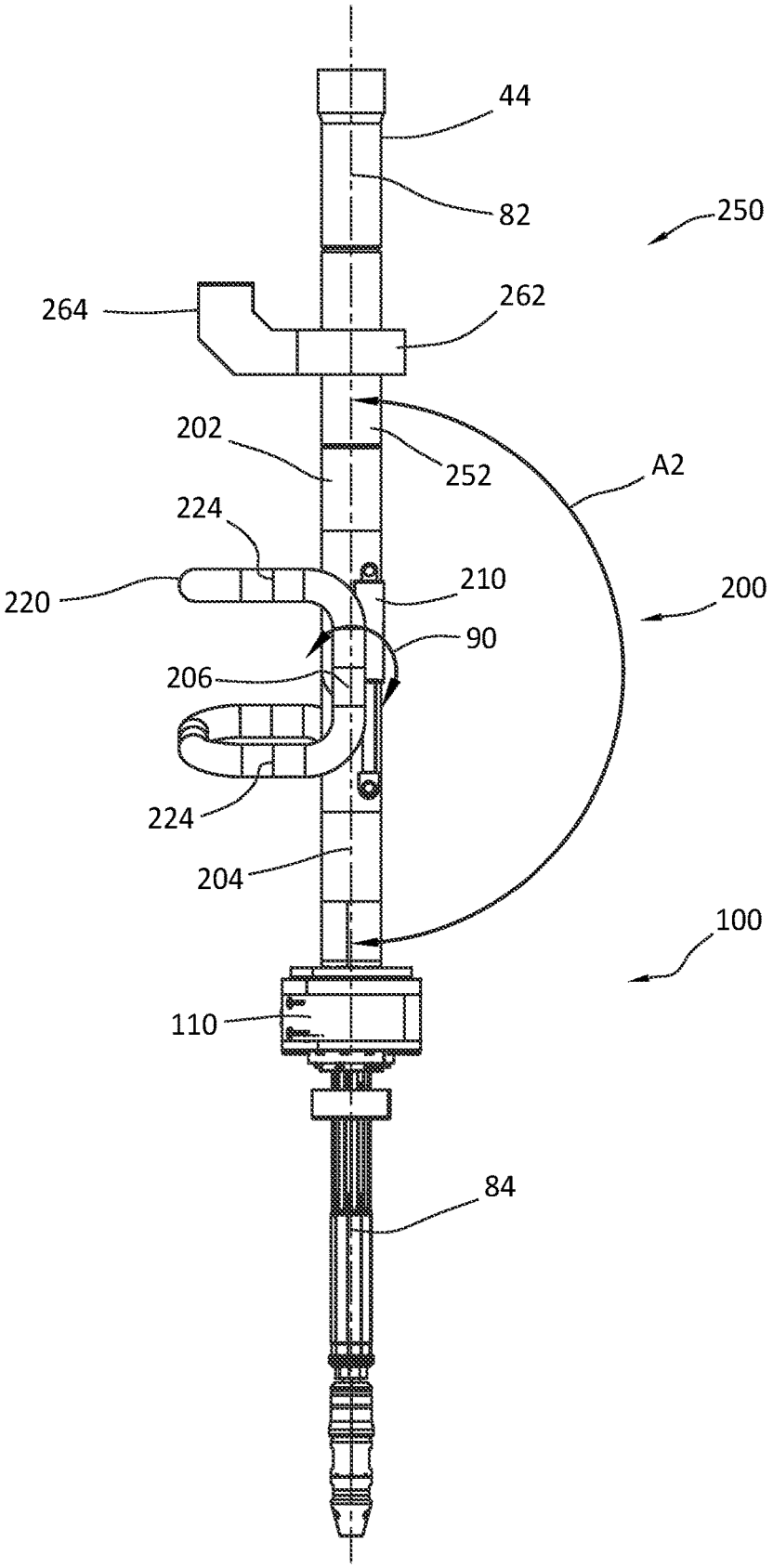
FIG. 15 is a representative side view of a pivot joint coupled between a sub and a RT, with the pivot joint fully extended, in accordance with certain embodiments.

FIG. 15 is a representative side view of a pivot joint 200 coupled between a sub 44 and a RT 100, with the pivot joint 200 fully extended, in accordance with certain embodiments. The flexible conduit 220 is shown in a similar configuration to the one shown in FIG. 14, such that the center axis 82 of the upper section 202 is generally aligned with the center axis 84 of the lower portion 204 (e.g., the angle A2 is generally at 180 degrees). In some embodiments the actuators 210, 212 can be extended further to increase the angle A2 to at least 190 degrees Angles for A2 of greater than 180 degrees and smaller than 90 degrees can be beneficial when the tubular string 28 is possibly mis-aligned with the top drive, the RT 100 is retrieving a tubular 38 from a vertical storage area and the tubular 38 is tilted from vertical, the catwalk 80 presents the tubular 38 to well center 25 at a downward incline, or other situations that require the RT 100 to align with a tubular that is oriented outside of the 90 degrees to 180 degrees orientation of the pivot joint 200.

Figure 16:
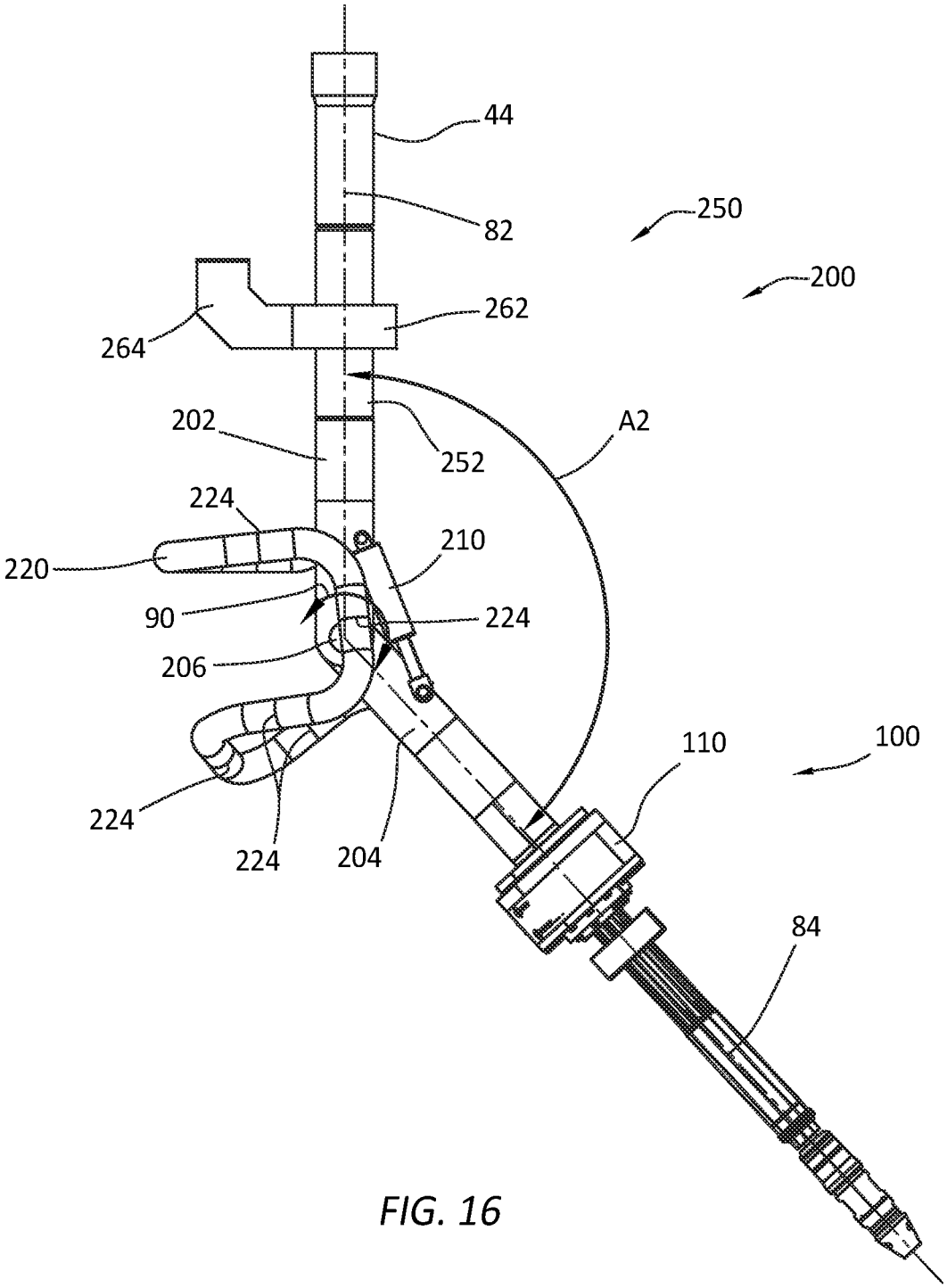
FIG. 16 is a representative side view of a pivot joint coupled between a sub and a RT, with the pivot joint rotated to an intermediate azimuthal orientation, in accordance with certain embodiments.

FIG. 16 is a representative side view of a pivot joint 200 coupled between a sub 44 and a RT 100, with the lower portion 204 of the pivot joint 200 rotated to an intermediate azimuthal orientation (e.g., angle A2 equal to 135 degrees), in accordance with certain embodiments. As can be seen the actuators 210, 212 have been retracted from the configuration in FIG. 15, thereby rotating the lower portion 204 to the angle A2. The swivel joints 224 allow the flexible conduit 220 to flex to accommodate the rotation of the lower portion 204.

Figure 17:
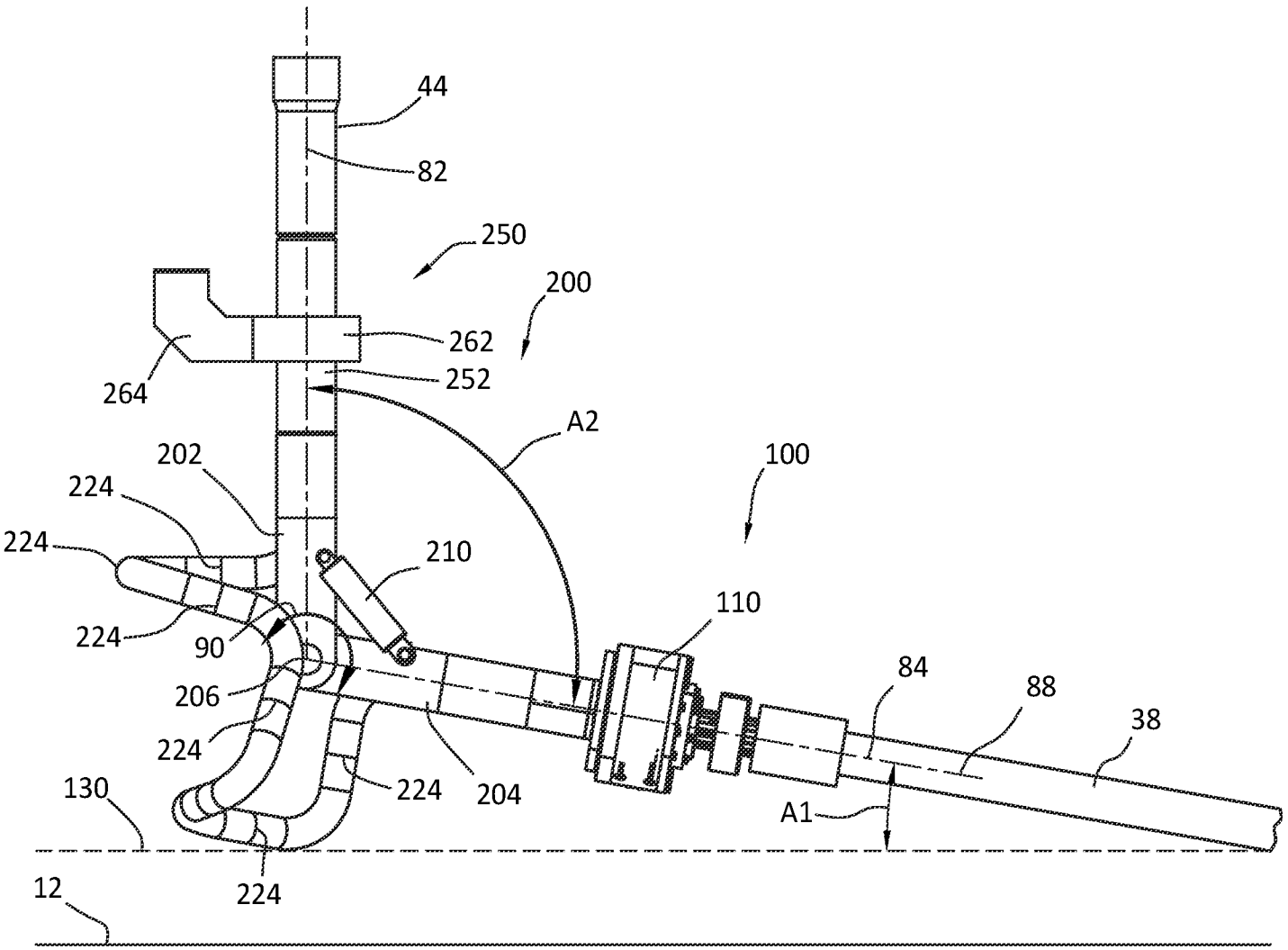
FIG. 17 is a representative side view of a pivot joint coupled between a sub and a RT, with the pivot joint rotated to align the RT with a tubular on a catwalk, in accordance with certain embodiments.

FIG. 17 is a representative side view of a pivot joint 200 coupled between a sub 44 and a RT 100, with the pivot joint 200 rotated to align the RT 100 with a tubular 38 on a catwalk 80 (e.g., align the center axis 84 of the RT 100 with the center axis 88 of the tubular 38 where the center axis 84 is positioned at an angle A1 from the reference line 130 (or rig floor 12), in accordance with certain embodiments. The tubular 38 has been extended from the catwalk 80 to insert the gripper end 104 of the RT 100 into the tubular 38. The control lines 111 can be used to operate the actuator 110, to engage or disengage the tubular 38. It should be understood, as mentioned above, that the RT 100 can also be an external RT where the gripper end 104 surrounds the end of the tubular 38 and engages an external surface of the tubular 38. As can be seen the actuators 210, 212 have been retracted from the configuration in FIG. 16, thereby rotating the lower portion 204 to the angle A2 (e.g., 100 degrees). The swivel joints 224 continue to allow the flexible conduit 220 to flex to accommodate the rotation of the lower portion 204.

VARIOUS EMBODIMENTS

Embodiment 1. A system for running a tubular string into or out of a wellbore, the system comprising:

a top drive with a quill; and a pivot joint coupled between the quill and a running tool, the pivot joint comprising an upper portion that is pivotably coupled to a lower portion via a pivot, wherein rotation of the lower portion relative to the upper portion pivots the running tool about the pivot.

Embodiment 2. The system of embodiment 1, further comprising one or more actuators coupled between the upper portion and the lower portion, wherein retraction of the one or more actuators pivots the lower portion in a first direction, and extension of the one or more actuators pivots the lower portion in a second direction.

Embodiment 3. The system of embodiment 2, wherein the one or more actuators pivot the running tool to align a center axis of the running tool with a center axis of a tubular on a catwalk.

Embodiment 4. The system of embodiment 3, wherein the tubular string is a casing string, and the tubular is a casing segment.

Embodiment 5. The system of embodiment 2, wherein the one or more actuators pivot the running tool to an angle relative to a rig floor that aligns a center axis of the running tool with a center axis of a tubular on a catwalk.

Embodiment 6. The system of embodiment 1, wherein the pivot joint pivots the running tool about a center axis of the pivot, and wherein the center axis of the pivot is substantially parallel with a rig floor.

Embodiment 7. The system of embodiment 6, wherein the center axis of the pivot is substantially perpendicular to a center axis of the quill.

Embodiment 8. The system of embodiment 1, wherein the quill rotates the pivot joint about a center axis of the quill.

Embodiment 9. The system of embodiment 1, further comprising a tubular on a catwalk, with the tubular being disposed at an azimuthal position from the pivot joint, wherein the azimuthal position is relative to a center axis of the quill, and wherein the quill rotates the pivot joint about a center axis of the quill to the azimuthal position and aligns the running tool with a tubular on the catwalk.

Embodiment 10. The system of embodiment 9, wherein the tubular on the catwalk is positioned at an angle relative to a rig floor, and wherein the pivot joint pivots the running tool about the pivot to position a center axis of the running tool at the angle relative to the rig floor, such that the center axis of the running tool is aligned with a center axis of the tubular.

Embodiment 11. The system of embodiment 10, further comprising an adjustable mechanical device that engages the running tool when the running tool is aligned with the tubular.

Embodiment 12. The system of embodiment 10, further comprising an adjustable mechanical device that engages the lower portion when the running tool is aligned with the tubular.

Embodiment 13. The system of embodiment 1, further comprising an internal flow passage that extends through the quill, the pivot joint, and the running tool, wherein at least a portion of the internal flow passage is extended past the pivot by a flexible conduit.

Embodiment 14. The system of embodiment 13, wherein one end of the flexible conduit is coupled to the upper portion and an opposite end of the flexible conduit is coupled to the lower portion, and wherein fluid flow from the quill flows into the upper portion, through the flexible conduit, into the lower portion, and through the running tool.

Embodiment 15. The system of embodiment 1, wherein a flexible conduit provides a flow path from the upper portion to the lower portion, such that fluid flow from the quill to the upper portion will bypass the pivot and flow to the lower portion.

Embodiment 16. The system of embodiment 15, wherein the flexible conduit comprises a resilient hose.

Embodiment 17. The system of embodiment 15, wherein the flexible conduit comprises multiple elbows and multiple swivel joints, with each of the multiple swivel joints is coupled between two adjacent ones of the multiple elbows, and wherein the swivel joints allow rotation of the two adjacent ones relative to each other.

Embodiment 18. The system of embodiment 1, further comprising a rotary manifold coupled between the pivot joint and the quill, with control lines coupled between the rotary manifold and one or more actuators of the pivot joint and an actuator of the running tool.

Embodiment 19. The system of embodiment 18, wherein the control lines are electrical control lines, hydraulic control lines, or a combination thereof.

Embodiment 20. The system of embodiment 18, wherein control signals are routed from the top drive, through the rotary manifold, and through the control lines to the one or more actuators of the pivot joint or the actuator of the running tool.

Embodiment 21. The system of embodiment 20, wherein control signals control actuation of the one or more actuators of the pivot joint or the actuator of the running tool.

Embodiment 22. The system of embodiment 18, wherein the rotary manifold further comprises data lines coupled between the rotary manifold and the pivot joint and between the rotary manifold and the running tool.

Embodiment 23. The system of embodiment 22, wherein the data lines communicate data signals from the pivot joint and the running tool to a rig controller, and wherein the data signals are representative of sensor data collected from sensors in the pivot joint and the running tool.

Embodiment 24. The system of embodiment 23, wherein the data signals are transmitted to the rig controller via wireless telemetry.

Embodiment 25. The system of embodiment 23, wherein the data signals are transferred through the rotary manifold via an electrical slip ring.

Embodiment 26. The system of embodiment 22, wherein the data lines are electrical lines that carry electrical signals or hydraulic lines that carry hydraulic signals.

Embodiment 27. The system of embodiment 18, wherein the rotary manifold comprises a stationary portion that is fixedly coupled to the top drive and a rotary portion that is rotationally coupled to the stationary portion.

Embodiment 28. The system of embodiment 27, wherein control signals are transferred between the stationary portion and the rotary portion to provide communication from a rig controller to the pivot joint and the running tool to control actuation of the pivot joint or the running tool.

Embodiment 29. A method for running a tubular string in a subterranean operation, the method comprising:

moving a tubular along a catwalk toward a well center, wherein the tubular is disposed at an angle, relative to a rig floor;

coupling a pivot joint between a running tool and a quill of a top drive, wherein the pivot joint comprises an upper portion that is pivotably coupled to a lower portion via a pivot;

lowering the top drive to a desired location to receive the tubular via the running tool; and pivoting the running tool about the pivot by pivoting the lower portion relative to the upper portion.

Embodiment 30. The method of embodiment 29, wherein pivoting the running tool about the pivot further comprises pivoting the running tool about the pivot to substantially position a center axis of the running tool at the angle relative to the rig floor.

Embodiment 31. The method of embodiment 29, further comprising aligning a center axis of the running tool with a center axis of the tubular at least in part by pivoting the running tool about the pivot.

Embodiment 32. The method of embodiment 31, further comprising engaging the lower portion with an adjustable mechanical device, thereby preventing further upward pivoting of the running tool.

Embodiment 33. The method of embodiment 29, further comprising aligning a center axis of the running tool with a center axis of the tubular at least in part by rotating the running tool about a center axis of the quill.

Embodiment 34. The method of embodiment 33, further comprising engaging the running tool with an adjustable mechanical device, thereby preventing further rotation of the running tool.

Embodiment 35. The method of embodiment 29, wherein moving the tubular along the catwalk further comprises extending the tubular from an end of the catwalk and receiving the tubular via the running tool.

Embodiment 36. The method of embodiment 29, further comprising confirming, via one or more sensors, a radial position of the lower portion relative to the upper portion, or an azimuthal position of the pivot joint relative to the top drive.

Embodiment 37. The method of embodiment 36, further comprising transmitting sensor data from the one or more sensors to a rig controller via wireless telemetry.

Embodiment 38. The method of embodiment 29, further comprising engaging an end of the tubular with the running tool.

Embodiment 39. The method of embodiment 38, further comprising:

receiving a control signal, via a rotary manifold, from a rig controller to the running tool; and actuating the running tool to engage or disengage the tubular in response to the control signal.

Embodiment 40. The method of embodiment 38, wherein the running tool engages either an inner surface or an outer surface of the tubular.

Embodiment 41. The method of embodiment 38, further comprising lifting, via the engagement of the end of the tubular, the end of the tubular by raising the top drive.

Embodiment 42. The method of embodiment 41, further comprising:

lifting, via the engagement of the end of the tubular, the end of the tubular by raising the top drive; and pivoting the tubular about the pivot from the angle relative to the rig floor to a substantially vertical orientation relative to the rig floor.

Embodiment 43. The method of embodiment 42, further comprising:

engaging a stickup of a tubular string at the well center with an opposite end of the tubular;

rotating the tubular relative to the tubular string by rotating the pivot joint; and making up a connection of the tubular to the tubular string.

Embodiment 44. The method of embodiment 43, wherein the tubular string is a casing string, and the tubular is a casing segment.

Embodiment 45. The method of embodiment 43, further comprising:

after making up the connection, lowering the tubular string into a wellbore until the end of the tubular that is engaged with the running tool is at a desired height above the rig floor;

disengaging the running tool from the tubular; and pivoting the running tool about the pivot to receive a next tubular.

Embodiment 46. The method of embodiment 29, further comprising:

coupling a rotary manifold between the upper portion of the pivot joint and the quill; and transmitting signals, via the rotary manifold, between the top drive and an instrumented sub, the running tool, the pivot joint, or combinations thereof, wherein the instrumented sub is coupled between the pivot joint and the quill.

Embodiment 47. The method of embodiment 46, wherein the signals comprise control signals for actuating the running tool, the pivot joint, or a combination thereof.

Embodiment 48. The method of embodiment 46, wherein the signals comprise data signals that transmit sensor data from an instrumented sub, the running tool, the pivot joint, or combinations thereof.

Embodiment 49. The method of embodiment 46, wherein the signals comprise electric signals, hydraulic signals, or combinations thereof.

Embodiment 50. The method of embodiment 29, wherein pivoting the running tool about the pivot further comprises extending one or more actuators, thereby pivoting the lower portion about the pivot in a first direction, or retracting the one or more actuators, thereby pivoting the lower portion about the pivot in a second direction.

Embodiment 51. A method for running a tubular string in a subterranean operation, the method comprising:

coupling a pivot joint between a running tool and a quill of a top drive, wherein the pivot joint comprises an upper portion that is pivotably coupled to a lower portion via a pivot;

engaging, via the running tool, a tubular string at a well center;

raising the tubular string from a wellbore by raising the top drive to a desired vertical height;

breaking up a connection between a tubular at a top of the tubular string and the tubular string; and pivoting the running tool about the pivot by pivoting the lower portion relative to the upper portion, thereby pivoting the tubular about the pivot.

Embodiment 52. The method of embodiment 51, further comprising confirming, via one or more sensors, a radial position of the lower portion relative to the upper portion, or an azimuthal position of the pivot joint relative to the top drive.

Embodiment 53. The method of embodiment 52, further comprising transmitting sensor data from the one or more sensors to a rig controller via wireless telemetry.

Embodiment 54. The method of embodiment 51, further comprising:

lowering the top drive while pivoting the tubular and the running tool, with a lower end of the tubular positioned on a catwalk and an upper end of the tubular being engaged with the running tool;

lowering the tubular onto the catwalk;

disengaging the running tool from the tubular; and moving the tubular along the catwalk to a horizontal storage area.

Embodiment 55. The method of embodiment 54, wherein engaging the tubular string further comprises:

receiving a control signal, via a rotary manifold, from a rig controller to the running tool; and actuating the running tool to engage or disengage the tubular in response to the control signal.

Embodiment 56. The method of embodiment 54, wherein the running tool engages either an inner surface or an outer surface of the tubular.

Embodiment 57. The method of embodiment 54, further comprising:

pivoting the running tool about the pivot from an angle aligned with the tubular on the catwalk to a substantially vertical orientation, relative to a rig floor;

lowering the running tool by lowering the top drive; and again engaging, via the running tool, the tubular string at the well center.

Embodiment 58. The method of embodiment 54, further comprising:

coupling a rotary manifold between the upper portion of the pivot joint and the quill; and transmitting signals, via the rotary manifold, between the top drive and an instrumented sub, the running tool, the pivot joint, or combinations thereof, wherein the instrumented sub is coupled between the pivot joint and the quill.

Embodiment 59. The method of embodiment 58, wherein the signals comprise control signals for actuating the running tool, the pivot joint, or a combination thereof.

Embodiment 60. The method of embodiment 58, wherein the signals comprise data signals that transmit sensor data from an instrumented sub, the running tool, the pivot joint, or combinations thereof.

Embodiment 61. The method of embodiment 58, wherein the signals comprise electric signals, hydraulic signals, or combinations thereof.

Embodiment 62. The method of embodiment 51, wherein pivoting the running tool about the pivot further comprises extending one or more actuators, thereby pivoting the lower portion about the pivot in a first direction, or retracting the one or more actuators, thereby pivoting the lower portion about the pivot in a second direction.

Embodiment 63. The method of embodiment 50, wherein the tubular string is a casing string, and the tubular is a casing segment.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for running a tubular string into or out of a wellbore, the system comprising:

a top drive with a quill;

a running tool; and a pivot joint coupled between the quill and the running tool, the pivot joint comprising an upper portion that is pivotably coupled to a lower portion via a pivot, wherein rotation of the lower portion relative to the upper portion pivots the running tool about the pivot, and wherein a flexible conduit provides a flow path from the upper portion to the lower portion, such that fluid flow from the quill to the upper portion will bypass the pivot and flow to the lower portion.

2. The system of claim 1, further comprising:

one or more actuators coupled between the upper portion and the lower portion, wherein retraction of the one or more actuators pivots the lower portion in a first direction, and extension of the one or more actuators pivots the lower portion in a second direction.

3. The system of claim 2, wherein the one or more actuators rotate the running tool to an angle relative to a rig floor that aligns a center axis of the running tool with a center axis of a tubular.

4. The system of claim 1, further comprising a tubular on a catwalk, with the tubular being disposed at an azimuthal position from the pivot joint, wherein the azimuthal position is relative to a center axis of the quill, and wherein the quill rotates the pivot joint about the center axis of the quill to the azimuthal position and aligns the running tool with the tubular on the catwalk.

5. The system of claim 4, wherein the tubular on the catwalk is positioned at an angle relative to a rig floor, and wherein the pivot joint rotates the running tool about the pivot to position a center axis of the running tool at the angle relative to the rig floor, such that the center axis of the running tool is aligned with a center axis of the tubular.

6. The system of claim 1, wherein the flow path extends through the quill, the pivot joint, and the running tool.

7. The system of claim 6, wherein one end of the flexible conduit is coupled to the upper portion and an opposite end of the flexible conduit is coupled to the lower portion, and wherein fluid flow from the quill flows into the upper portion, through the flexible conduit, and into the lower portion.

8. The system of claim 1, wherein the flexible conduit comprises a resilient hose.

9. The system of claim 1, further comprising a rotary manifold coupled between the pivot joint and the quill, with control lines coupled between the rotary manifold and one or more actuators of the pivot joint and an actuator of the running tool.

10. The system of claim 9, wherein control signals are routed from the top drive, through the rotary manifold, and through the control lines to the one or more actuators of the pivot joint or the actuator of the running tool, and wherein the control signals control actuation of the one or more actuators of the pivot joint or the actuator of the running tool.

11. The system of claim 9, wherein the rotary manifold comprises a stationary portion that is fixedly coupled to the top drive and a rotary portion that is rotationally coupled to the stationary portion, and wherein control signals are transferred between the stationary portion and the rotary portion to provide communication from a rig controller to the pivot joint and the running tool to control actuation of the pivot joint or the running tool.

12. A method for running a tubular string in a subterranean operation, the method comprising:

moving a tubular toward a well center, wherein the tubular is disposed at an angle, relative to a rig floor;

coupling a pivot joint between a running tool and a quill of a top drive, wherein the pivot joint comprises an upper portion that is pivotably coupled to a lower portion via a pivot;

coupling a rotary manifold between the pivot joint and the quill, wherein the rotary manifold comprises a stationary portion that is fixedly coupled to the top drive and a rotary portion that is rotationally coupled to the stationary portion;

transferring signals between the stationary portion and the rotary portion to provide communication from a rig controller to the pivot joint and the running tool to control actuation of the pivot joint or the running tool; and pivoting the running tool about the pivot via actuation of the pivot joint in response to the signals, wherein actuation of the pivot joint causes the lower portion to rotate about the pivot relative to the upper portion.

13. The method of claim 12, further comprising aligning a center axis of the running tool with a center axis of the tubular at least in part by pivoting the running tool about the pivot or by rotating the running tool about a center axis of the quill.

14. The method of claim 12, further comprising:

engaging an end of the tubular with the running tool;

lifting the end of the tubular, via engagement of the running tool with the end of the tubular, by raising the top drive; and pivoting the tubular about the pivot from the angle relative to the rig floor to a substantially vertical orientation relative to the rig floor.

15. A method for running a tubular string in a subterranean operation, the method comprising:

coupling a pivot joint between a running tool and a quill of a top drive, wherein the pivot joint comprises an upper portion that is pivotably coupled to a lower portion via a pivot;

engaging, via the running tool, a tubular string at a well center;

raising the tubular string from a wellbore by raising the top drive to a desired vertical height;

breaking up a connection between a tubular at a top of the tubular string and the tubular string;

pivoting the running tool about the pivot by pivoting the lower portion relative to the upper portion, thereby pivoting the tubular about the pivot;

coupling a rotary manifold between the upper portion of the pivot joint and the quill; and transmitting signals, via the rotary manifold, between the top drive and an instrumented sub, the running tool, the pivot joint, or combinations thereof.

16. The method of claim 15, further comprising:

lowering the top drive while pivoting the tubular and the running tool, with a lower end of the tubular positioned on a catwalk and an upper end of the tubular being engaged with the running tool;

lowering the tubular onto the catwalk;

disengaging the running tool from the tubular; and moving the tubular along the catwalk away from the running tool.

17. The method of claim 16, wherein engaging the tubular string further comprises:

receiving a control signal, via the rotary manifold, from a rig controller to the running tool; and actuating the running tool to engage or disengage the tubular in response to the control signal.

18. The method of claim 16, wherein the running tool engages either an inner surface or an outer surface of the tubular.

19. The method of claim 16, further comprising:

pivoting the running tool about the pivot from an angle aligned with the tubular on the catwalk to a substantially vertical orientation, relative to a rig floor;

lowering the running tool by lowering the top drive; and again engaging, via the running tool, the tubular string at the well center.

20. The method of claim 15, wherein the signals comprise control signals for actuating the running tool, the pivot point, or a combination thereof.

* * * * *